US012624622B2

(12) United States Patent
Oehring

(10) Patent No.: US 12,624,622 B2
(45) Date of Patent: May 12, 2026

(54) CABLE MANAGEMENT OF ELECTRIC POWERED HYDRAULIC FRACTURING PUMP UNIT

(71) Applicant: U.S. Well Services, LLC, Willow Park, TX (US)

(72) Inventor: Jared Oehring, Willow Park, TX (US)

(73) Assignee: U.S. Well Services, LLC, Willow Park, TX (US)

( * ) Notice: Subject to any disclaimer, the term of this patent is extended or adjusted under 35 U.S.C. 154(b) by 0 days.

(21) Appl. No.: 19/016,414

(22) Filed: Jan. 10, 2025

(65) Prior Publication Data

US 2025/0223896 A1 Jul. 10, 2025

Related U.S. Application Data

(63) Continuation of application No. 18/211,791, filed on Jun. 20, 2023, now Pat. No. 12,228,023, which is a continuation of application No. 17/202,412, filed on Mar. 16, 2021, now Pat. No. 11,680,473, which is a continuation of application No. 16/047,653, filed on Jul. 27, 2018, now Pat. No. 10,947,829, which is a (Continued)

(51) Int. Cl.

| | |
|---|---|
| ***E21B 43/26*** | (2006.01) |
| ***F04B 23/04*** | (2006.01) |
| ***F04B 47/06*** | (2006.01) |

(52) U.S. Cl.

CPC ..... *E21B 43/2607* (2020.05); *E21B 43/26* (2013.01); *F04B 23/04* (2013.01); *F04B 47/06* (2013.01)

(58) Field of Classification Search

CPC ..... E21B 43/26; E21B 43/2607

See application file for complete search history.

(56) References Cited

U.S. PATENT DOCUMENTS

| | | | |
|---|---|---|---|
| 1,656,861 | A | 1/1928 | Leonard |
| 1,671,436 | A | 5/1928 | Melott |

(Continued)

FOREIGN PATENT DOCUMENTS

| | | |
|---|---|---|
| AU | 2007340913 | 7/2008 |
| CA | 2406801 | 11/2001 |

(Continued)

OTHER PUBLICATIONS

"Griswold Model 811 Pumps: Installation, Operation and Maintenance Manual, ANSI Process Pump", 2010, 60 pages.

(Continued)

*Primary Examiner* — Kenneth L Thompson

(74) *Attorney, Agent, or Firm* — Henry Patent Law Firm PLLC

(57) ABSTRACT

A hydraulic fracturing system includes a pump, an electrically powered motor for driving the pump, a trailer on which the pump and motor are mounted, and a transformer that steps down electricity for use by the motor. Electrical output from the transformer connects to a series of receptacles mounted onto a housing around the transformer. A similar set of receptacles is provided on the trailer and which are electrically connected to the motor. Power cables equipped with plugs on their opposing ends insert into the receptacles to close an electrical circuit between the transformer and pump.

20 Claims, 8 Drawing Sheets

Related U.S. Application Data continuation of application No. 15/145,491, filed on May 3, 2016, now Pat. No. 10,036,238, which is a continuation-in-part of application No. 13/679,689, filed on Nov. 16, 2012, now Pat. No. 9,410,410.

(60) Provisional application No. 62/156,303, filed on May 3, 2015.

(56) References Cited

U.S. PATENT DOCUMENTS

| | | | |
|---|---|---|---|
| 2,004,077 | A | 6/1935 | Mccartney et al. |
| 2,183,364 | A | 12/1939 | Bailey |
| 2,220,622 | A | 11/1940 | Homer |
| 2,248,051 | A | 7/1941 | Armstrong et al. |
| 2,407,796 | A | 9/1946 | Page |
| 2,416,848 | A | 3/1947 | Stewart |
| 2,610,741 | A | 9/1952 | Schmid |
| 2,753,940 | A | 7/1956 | Bonner |
| 2,778,957 | A | 1/1957 | Fuchs |
| 2,976,025 | A | 3/1961 | Pro |
| 3,055,682 | A | 9/1962 | Bacher et al. |
| 3,061,039 | A | 10/1962 | Peters |
| 3,066,503 | A | 12/1962 | Fleming et al. |
| 3,302,069 | A | 1/1967 | Wilcox |
| 3,334,495 | A | 8/1967 | Jensen et al. |
| 3,722,595 | A | 3/1973 | Kiel |
| 3,764,233 | A | 10/1973 | Strickland |
| 3,773,140 | A | 11/1973 | Mahajan et al. |
| 3,837,179 | A | 9/1974 | Barth |
| 3,849,662 | A | 11/1974 | Blaskowski et al. |
| 3,881,551 | A | 5/1975 | Terry et al. |
| 4,037,431 | A | 7/1977 | Sugimoto |
| 4,100,822 | A | 7/1978 | Rosman |
| 4,140,918 | A | 2/1979 | Lancaster |
| 4,151,575 | A | 4/1979 | Hogue |
| 4,226,299 | A | 10/1980 | Hansen |
| 4,265,266 | A | 5/1981 | Kierbow et al. |
| 4,411,313 | A | 10/1983 | Johnson et al. |
| 4,432,064 | A | 2/1984 | Barker et al. |
| 4,442,665 | A | 4/1984 | Fick et al. |
| 4,456,092 | A | 6/1984 | Kubozuka et al. |
| 4,506,982 | A | 3/1985 | Smithers et al. |
| 4,512,387 | A | 4/1985 | Rodriguez et al. |
| 4,529,887 | A | 7/1985 | Johnson |
| 4,538,916 | A | 9/1985 | Zimmerman |
| 4,601,629 | A | 7/1986 | Zimmerman |
| 4,676,063 | A | 6/1987 | Goebel et al. |
| 4,759,674 | A | 7/1988 | Schröder et al. |
| 4,768,884 | A | 9/1988 | Elkin et al. |
| 4,793,386 | A | 12/1988 | Sloan |
| 4,845,981 | A | 7/1989 | Pearson |
| 4,922,463 | A | 5/1990 | Del Zotto et al. |
| 5,004,400 | A | 4/1991 | Handke |
| 5,006,044 | A | 4/1991 | Walker, Sr. et al. |
| 5,025,861 | A | 6/1991 | Huber et al. |
| 5,050,673 | A | 9/1991 | Baldridge |
| 5,114,239 | A | 5/1992 | Allen |
| 5,130,628 | A | 7/1992 | Owen |
| 5,131,472 | A | 7/1992 | Dees et al. |
| 5,172,009 | A | 12/1992 | Mohan |
| 5,189,388 | A | 2/1993 | Mosley et al. |
| 5,230,366 | A | 7/1993 | Marandi |
| 5,334,899 | A | 8/1994 | Skybyk |
| 5,366,324 | A | 11/1994 | Arlt |
| 5,422,550 | A | 6/1995 | Mcclanahan et al. |
| 5,433,243 | A | 7/1995 | Griswold et al. |
| 5,486,047 | A | 1/1996 | Zimmerman |
| 5,517,822 | A | 5/1996 | Haws et al. |
| 5,544,003 | A | 8/1996 | Vaughan |
| 5,548,093 | A | 8/1996 | Sato et al. |
| 5,590,976 | A | 1/1997 | Kilheffer et al. |
| 5,655,361 | A | 8/1997 | Kishi |
| 5,665,939 | A | 9/1997 | Jorgensen et al. |
| 5,736,838 | A | 4/1998 | Dove et al. |
| 5,755,096 | A | 5/1998 | Holleyman |
| 5,790,972 | A | 8/1998 | Kohlenberger |
| 5,798,596 | A | 8/1998 | Lordo |
| 5,813,455 | A | 9/1998 | Pratt et al. |
| 5,865,247 | A | 2/1999 | Paterson |
| 5,879,137 | A | 3/1999 | Yie |
| 5,894,888 | A | 4/1999 | Wiemers et al. |
| 5,907,970 | A | 6/1999 | Havlovick et al. |
| 5,950,726 | A | 9/1999 | Roberts |
| 6,035,265 | A | 3/2000 | Dister et al. |
| 6,097,310 | A | 8/2000 | Harrell et al. |
| 6,121,705 | A | 9/2000 | Hoong |
| 6,138,764 | A | 10/2000 | Scarsdale et al. |
| 6,142,878 | A | 11/2000 | Barin |
| 6,164,910 | A | 12/2000 | Mayleben |
| 6,191,500 | B1 | 2/2001 | Toy |
| 6,202,702 | B1 | 3/2001 | Ohira et al. |
| 6,208,098 | B1 | 3/2001 | Kume et al. |
| 6,254,462 | B1 | 7/2001 | Kelton et al. |
| 6,271,637 | B1 | 8/2001 | Kushion |
| 6,273,193 | B1 | 8/2001 | Hermann et al. |
| 6,315,523 | B1 | 11/2001 | Mills |
| 6,442,942 | B1 | 9/2002 | Kopko |
| 6,477,852 | B2 | 11/2002 | Dodo et al. |
| 6,484,490 | B1 | 11/2002 | Olsen et al. |
| 6,491,098 | B1 | 12/2002 | Dallas |
| 6,529,135 | B1 | 3/2003 | Bowers et al. |
| 6,585,455 | B1 | 7/2003 | Petersen et al. |
| 6,626,646 | B2 | 9/2003 | Rajewski |
| 6,719,900 | B2 | 4/2004 | Hawkins |
| 6,765,304 | B2 | 7/2004 | Baten et al. |
| 6,776,227 | B2 | 8/2004 | Beida et al. |
| 6,788,022 | B2 | 9/2004 | Sopko et al. |
| 6,802,690 | B2 | 10/2004 | Han et al. |
| 6,808,303 | B2 | 10/2004 | Fisher |
| 6,931,310 | B2 | 8/2005 | Shimizu et al. |
| 6,936,947 | B1 | 8/2005 | Leijon et al. |
| 7,082,993 | B2 | 8/2006 | Ayoub et al. |
| 7,104,233 | B2 | 9/2006 | Ryczek |
| 7,170,262 | B2 | 1/2007 | Pettigrew |
| 7,173,399 | B2 | 2/2007 | Sihler et al. |
| 7,308,933 | B1 | 12/2007 | Mayfield |
| 7,312,593 | B1 | 12/2007 | Streicher et al. |
| 7,336,514 | B2 | 2/2008 | Amarillas et al. |
| 7,445,041 | B2 | 11/2008 | O'Brien |
| 7,494,263 | B2 | 2/2009 | Dykstra et al. |
| 7,500,642 | B2 | 3/2009 | Cunningham et al. |
| 7,525,264 | B2 | 4/2009 | Dodge |
| 7,563,076 | B2 | 7/2009 | Brunet et al. |
| 7,581,379 | B2 | 9/2009 | Yoshida et al. |
| 7,675,189 | B2 | 3/2010 | Grenier |
| 7,683,499 | B2 | 3/2010 | Saucier |
| 7,717,193 | B2 | 5/2010 | Egilsson et al. |
| 7,755,310 | B2 | 7/2010 | West et al. |
| 7,795,830 | B2 | 9/2010 | Johnson |
| 7,807,048 | B2 | 10/2010 | Collette |
| 7,835,140 | B2 | 11/2010 | Mori et al. |
| 7,845,413 | B2 | 12/2010 | Shampine et al. |
| 7,926,562 | B2 | 4/2011 | Poitzsch et al. |
| 7,977,824 | B2 | 7/2011 | Halen et al. |
| 7,984,757 | B1 | 7/2011 | Keast et al. |
| 8,037,936 | B2 | 10/2011 | Neuroth et al. |
| 8,054,084 | B2 | 11/2011 | Schulz et al. |
| 8,083,504 | B2 | 12/2011 | Williams et al. |
| 8,091,928 | B2 | 1/2012 | Carrier et al. |
| 8,096,354 | B2 | 1/2012 | Poitzsch |
| 8,096,891 | B2 | 1/2012 | Lochtefeld et al. |
| 8,139,383 | B2 | 3/2012 | Efraimsson et al. |
| 8,146,665 | B2 | 4/2012 | Neal |
| 8,154,419 | B2 | 4/2012 | Daussin et al. |
| 8,232,892 | B2 | 7/2012 | Overholt et al. |
| 8,261,528 | B2 | 9/2012 | Chillar et al. |
| 8,272,439 | B2 | 9/2012 | Strickland |
| 8,310,272 | B2 | 11/2012 | Quarto |
| 8,354,817 | B2 | 1/2013 | Yeh et al. |
| 8,427,814 | B1 | 4/2013 | Gonce |
| 8,474,521 | B2 | 7/2013 | Kajaria et al. |
| 8,506,267 | B2 | 8/2013 | Gambier et al. |
| 8,534,235 | B2 | 9/2013 | Chandler |

(56) References Cited

U.S. PATENT DOCUMENTS 8,573,303 B2 11/2013 Kerfoot
8,596,056 B2 12/2013 Woodmansee et al.
8,616,005 B1 12/2013 Cousino, Sr.
8,616,274 B2 12/2013 Belcher et al.
8,646,521 B2 2/2014 Bowen
8,692,408 B2 4/2014 Zhang et al.
8,727,068 B2 5/2014 Bruin
8,760,657 B2 6/2014 Pope et al.
8,763,387 B2 7/2014 Schmidt
8,774,972 B2 7/2014 Rusnak et al.
8,789,601 B2 7/2014 Broussard et al.
8,795,525 B2 8/2014 Mcginnis et al.
8,800,652 B2 8/2014 Bartko et al.
8,807,960 B2 8/2014 Stephenson et al.
8,838,341 B2 9/2014 Kumano
8,851,860 B1 10/2014 Mail
8,857,506 B2 10/2014 Stone, Jr. et al.
8,899,940 B2 12/2014 Leugemors et al.
8,905,056 B2 12/2014 Kendrick
8,905,138 B2 12/2014 Lundstedt et al.
8,997,904 B2 4/2015 Cryer et al.
9,018,881 B2 4/2015 Mao et al.
9,051,822 B2 6/2015 Ayan et al.
9,051,923 B2 6/2015 Kuo
9,061,223 B2 6/2015 Winborn
9,067,182 B2 6/2015 Nichols et al.
9,103,193 B2 8/2015 Coli et al.
9,119,326 B2 8/2015 Mcdonnell et al.
9,121,257 B2 9/2015 Coli et al.
9,140,105 B2 9/2015 Pattillo
9,140,110 B2 9/2015 Coli et al.
9,160,168 B2 10/2015 Chapel et al.
9,175,554 B1 11/2015 Watson
9,206,684 B2 12/2015 Parra et al.
9,260,253 B2 2/2016 Naizer et al.
9,322,239 B2 4/2016 Angeles Boza et al.
9,324,049 B2 4/2016 Thomeer et al.
9,340,353 B2 5/2016 Oren et al.
9,353,593 B1 5/2016 Lu et al.
9,366,114 B2 6/2016 Coli et al.
9,410,410 B2 8/2016 Broussard et al.
9,450,385 B2 9/2016 Kristensen
9,458,687 B2 10/2016 Hallundbaek
9,475,020 B2 10/2016 Coli et al.
9,475,021 B2 10/2016 Coli et al.
9,482,086 B2 11/2016 Richardson et al.
9,499,335 B2 11/2016 Mciver et al.
9,513,055 B1 12/2016 Seal
9,534,473 B2 1/2017 Morris et al.
9,562,420 B2 2/2017 Morris et al.
9,587,649 B2 3/2017 Oehring
9,611,728 B2 4/2017 Oehring
9,638,194 B2 5/2017 Wiegman et al.
9,650,871 B2 5/2017 Oehring et al.
9,650,879 B2 5/2017 Broussard et al.
9,706,185 B2 7/2017 Ellis
9,728,354 B2 8/2017 Skolozdra et al.
9,738,461 B2 8/2017 Degaray et al.
9,739,546 B2 8/2017 Bertilsson et al.
9,745,840 B2 8/2017 Oehring et al.
9,790,858 B2 10/2017 Kanebako
9,840,901 B2 12/2017 Oehring et al.
9,863,228 B2 1/2018 Shampine et al.
9,893,500 B2 2/2018 Oehring et al.
9,909,398 B2 3/2018 Pham
9,915,128 B2 3/2018 Hunter
9,932,799 B2 4/2018 Symchuk
9,945,365 B2 4/2018 Hernandez et al.
9,963,961 B2 5/2018 Hardin
9,970,278 B2 5/2018 Broussard et al.
9,976,351 B2 5/2018 Randall
9,995,218 B2 6/2018 Oehring et al.
10,008,880 B2 6/2018 Vicknair et al.
10,020,711 B2 7/2018 Oehring et al.
10,036,238 B2 * 7/2018 Oehring ..... F04B 23/04
10,107,086 B2 10/2018 Oehring et al.
10,119,381 B2 11/2018 Oehring et al.
10,184,465 B2 1/2019 Enis et al.
10,196,878 B2 2/2019 Hunter
10,227,854 B2 3/2019 Glass
10,232,332 B2 3/2019 Oehring et al.
10,246,984 B2 4/2019 Payne et al.
10,254,732 B2 4/2019 Oehring et al.
10,260,327 B2 4/2019 Kajaria et al.
10,280,724 B2 5/2019 Hinderliter
10,287,873 B2 5/2019 Filas et al.
10,302,079 B2 5/2019 Kendrick
10,309,205 B2 6/2019 Randall
10,337,308 B2 7/2019 Broussard et al.
10,371,012 B2 8/2019 Davis et al.
10,378,326 B2 8/2019 Morris et al.
10,393,108 B2 8/2019 Chong et al.
10,407,990 B2 9/2019 Oehring et al.
10,415,332 B2 9/2019 Morris et al.
10,436,026 B2 10/2019 Ounadjela et al.
10,519,730 B2 * 12/2019 Morris ..... H03K 17/00
10,627,003 B2 4/2020 Dale et al.
10,648,270 B2 5/2020 Brunty et al.
10,648,311 B2 5/2020 Oehring et al.
10,669,471 B2 6/2020 Schmidt et al.
10,669,804 B2 6/2020 Kotrla et al.
10,686,301 B2 6/2020 Oehring et al.
10,695,950 B2 6/2020 Igo et al.
10,711,576 B2 7/2020 Bishop
10,731,561 B2 8/2020 Oehring et al.
10,753,153 B1 * 8/2020 Fischer ..... F04D 13/12
10,767,561 B2 9/2020 Brady
10,781,752 B2 9/2020 Kikkawa et al.
10,794,165 B2 10/2020 Fischer et al.
10,947,829 B2 * 3/2021 Oehring ..... E21B 43/2607
10,988,998 B2 4/2021 Fischer et al.
11,680,473 B2 * 6/2023 Oehring ..... E21B 43/2607 166/308.1
11,788,396 B2 * 10/2023 Fischer ..... F04B 47/02 166/177.5
11,859,482 B2 * 1/2024 Yeung ..... F04B 15/02
11,955,782 B1 * 4/2024 Martin ..... H02B 13/00
11,976,525 B2 * 5/2024 Fischer ..... F04D 13/0686
12,071,840 B2 * 8/2024 Cui ..... F04D 29/605
12,084,952 B2 * 9/2024 Robinson ..... E21B 43/2607
12,228,023 B2 * 2/2025 Oehring ..... F04B 47/06
2001/0000996 A1 5/2001 Grimland et al.
2002/0169523 A1 11/2002 Ross et al.
2003/0056514 A1 3/2003 Lohn
2003/0079875 A1 5/2003 Weng
2003/0138327 A1 7/2003 Jones et al.
2004/0040746 A1 3/2004 Niedermayr et al.
2004/0045703 A1 3/2004 Hooper et al.
2004/0102109 A1 5/2004 Cratty et al.
2004/0167738 A1 8/2004 Miller
2005/0061548 A1 3/2005 Hooper et al.
2005/0116541 A1 6/2005 Seiver
2005/0201197 A1 9/2005 Duell et al.
2005/0274508 A1 12/2005 Folk et al.
2006/0052903 A1 3/2006 Bassett
2006/0065319 A1 3/2006 Csitari
2006/0109141 A1 5/2006 Huang et al.
2006/0260331 A1 11/2006 Andreychuk
2007/0131410 A1 6/2007 Hill et al.
2007/0187163 A1 8/2007 Cone et al.
2007/0201305 A1 8/2007 Heilman et al.
2007/0226089 A1 9/2007 Degaray et al.
2007/0277982 A1 12/2007 Shampine et al.
2007/0278140 A1 12/2007 Mallett et al.
2008/0017369 A1 1/2008 Sarada
2008/0041596 A1 2/2008 Blount et al.
2008/0095644 A1 4/2008 Mantei et al.
2008/0112802 A1 5/2008 Orlando et al.
2008/0137266 A1 6/2008 Jensen et al.
2008/0164023 A1 7/2008 Dykstra et al.
2008/0208478 A1 8/2008 Ella et al.
2008/0217024 A1 9/2008 Moore
2008/0236818 A1 10/2008 Dykstra
2008/0257449 A1 10/2008 Weinstein et al.

(56) References Cited

U.S. PATENT DOCUMENTS

2008/0264625 A1 10/2008 Ochoa
2008/0264640 A1 10/2008 Eslinger
2008/0264649 A1 10/2008 Crawford
2009/0045782 A1 2/2009 Datta et al.
2009/0065299 A1 3/2009 Vito et al.
2009/0072645 A1 3/2009 Quere
2009/0078410 A1 3/2009 Krenek et al.
2009/0090504 A1 4/2009 Weightman et al.
2009/0093317 A1 4/2009 Kajiwara et al.
2009/0095482 A1 4/2009 Surjaatmadja
2009/0145611 A1 6/2009 Pallini, Jr. et al.
2009/0153354 A1 6/2009 Duassin et al.
2009/0188181 A1 7/2009 Forbis et al.
2009/0200035 A1 8/2009 Bjerkreim et al.
2009/0260826 A1 10/2009 Sherwood et al.
2009/0308602 A1 12/2009 Bruins et al.
2010/0000508 A1 1/2010 Chandler
2010/0019574 A1 1/2010 Baldassarre et al.
2010/0038907 A1 2/2010 Hunt et al.
2010/0045109 A1 2/2010 Arnold
2010/0051272 A1 3/2010 Loree et al.
2010/0101785 A1 4/2010 Khvoshchev et al.
2010/0132949 A1 6/2010 Defosse et al.
2010/0146981 A1 6/2010 Motakef et al.
2010/0172202 A1 7/2010 Borgstadt
2010/0200224 A1 8/2010 Nguete et al.
2010/0250139 A1 9/2010 Hobbs et al.
2010/0293973 A1 11/2010 Erickson
2010/0303655 A1 12/2010 Scekic
2010/0322802 A1 12/2010 Kugelev
2011/0000575 A1 1/2011 Herbert
2011/0017468 A1 1/2011 Birch et al.
2011/0052423 A1 3/2011 Gambier et al.
2011/0061855 A1 3/2011 Case et al.
2011/0081268 A1 4/2011 Ochoa et al.
2011/0085924 A1 4/2011 Shampine et al.
2011/0110793 A1 5/2011 Leugemors et al.
2011/0166046 A1 7/2011 Weaver et al.
2011/0247878 A1 10/2011 Rasheed et al.
2011/0272158 A1 11/2011 Neal
2012/0018016 A1 1/2012 Gibson et al.
2012/0049625 A1 3/2012 Hopwood
2012/0063936 A1 3/2012 Baxter et al.
2012/0085541 A1 4/2012 Love et al.
2012/0112757 A1 5/2012 Vrankovic et al.
2012/0127635 A1 5/2012 Grindeland
2012/0150455 A1 6/2012 Franklin et al.
2012/0152716 A1 6/2012 Kikukawa et al.
2012/0205301 A1 8/2012 Mcguire et al.
2012/0205400 A1 8/2012 Degaray et al.
2012/0222865 A1 9/2012 Larson et al.
2012/0232728 A1 9/2012 Karimi et al.
2012/0247783 A1 10/2012 Berner, Jr. et al.
2012/0255734 A1 10/2012 Coli et al.
2013/0009469 A1 1/2013 Gillett
2013/0025706 A1 1/2013 Degaray et al.
2013/0051971 A1 2/2013 Wyse et al.
2013/0175038 A1 7/2013 Conrad
2013/0175039 A1 7/2013 Guidry
2013/0180722 A1 7/2013 Olarte Caro
2013/0189629 A1 7/2013 Chandler
2013/0199617 A1 8/2013 Degaray et al.
2013/0233542 A1 9/2013 Shampine et al.
2013/0255271 A1 10/2013 Yu et al.
2013/0284278 A1 10/2013 Winborn
2013/0299167 A1 11/2013 Fordyce et al.
2013/0306322 A1 11/2013 Sanborn et al.
2013/0317750 A1 11/2013 Hunter
2013/0341029 A1 12/2013 Roberts et al.
2013/0343858 A1 12/2013 Flusche
2014/0000899 A1 1/2014 Nevison
2014/0010671 A1 1/2014 Cryer et al.
2014/0054965 A1 2/2014 Jain
2014/0060658 A1 3/2014 Hains et al.
2014/0095114 A1 4/2014 Thomeer et al.
2014/0096974 A1 4/2014 Coli et al.
2014/0124162 A1 5/2014 Leavitt
2014/0138079 A1 5/2014 Broussard et al.
2014/0174717 A1 6/2014 Broussard et al.
2014/0219824 A1 8/2014 Burnette
2014/0238683 A1 8/2014 Korach et al.
2014/0246211 A1 9/2014 Guidry et al.
2014/0251623 A1 9/2014 Lestz et al.
2014/0255214 A1 9/2014 Burnette
2014/0277772 A1 9/2014 Lopez et al.
2014/0290768 A1 10/2014 Randle et al.
2014/0379300 A1 12/2014 Devine et al.
2015/0027712 A1 1/2015 Vicknair et al.
2015/0053426 A1 2/2015 Smith et al.
2015/0068724 A1 3/2015 Coli et al.
2015/0068754 A1 3/2015 Coli et al.
2015/0075778 A1 3/2015 Walters et al.
2015/0083426 A1 3/2015 Lesko et al.
2015/0097504 A1 4/2015 Lamascus et al.
2015/0114652 A1 4/2015 Lestz et al.
2015/0136043 A1 5/2015 Shaaban et al.
2015/0144336 A1 5/2015 Hardin et al.
2015/0147194 A1 5/2015 Foote
2015/0159911 A1 6/2015 Holt
2015/0175013 A1 6/2015 Cryer et al.
2015/0176386 A1 6/2015 Castillo et al.
2015/0211512 A1 7/2015 Wiegman et al.
2015/0211524 A1 7/2015 Broussard et al.
2015/0217672 A1 8/2015 Shampine et al.
2015/0225113 A1 8/2015 Lungu et al.
2015/0233530 A1 8/2015 Sandidge
2015/0252661 A1 9/2015 Glass
2015/0300145 A1 10/2015 Coli et al.
2015/0300336 A1 10/2015 Hernandez et al.
2015/0314225 A1 11/2015 Parsons et al.
2015/0330172 A1 11/2015 Allmaras et al.
2015/0354322 A1 12/2015 Vicknair et al.
2016/0006311 A1 1/2016 Li
2016/0032703 A1 2/2016 Broussard et al.
2016/0102537 A1 4/2016 Lopez
2016/0105022 A1 4/2016 Oehring et al.
2016/0160889 A1 6/2016 Hoffman et al.
2016/0177675 A1 6/2016 Morris et al.
2016/0177678 A1 6/2016 Morris et al.
2016/0186531 A1 6/2016 Harkless et al.
2016/0208592 A1 7/2016 Oehring
2016/0208593 A1 7/2016 Coli et al.
2016/0208594 A1 7/2016 Coli et al.
2016/0208595 A1 7/2016 Tang et al.
2016/0221220 A1 8/2016 Paige
2016/0230524 A1 8/2016 Dumoit et al.
2016/0230525 A1 8/2016 Lestz et al.
2016/0230660 A1 8/2016 Zeitoun et al.
2016/0258267 A1 9/2016 Payne et al.
2016/0265457 A1 9/2016 Stephenson et al.
2016/0273328 A1 9/2016 Oehring
2016/0273456 A1 9/2016 Zhang
2016/0281484 A1 9/2016 Lestz et al.
2016/0290114 A1 10/2016 Oehring et al.
2016/0290563 A1 10/2016 Diggins
2016/0312108 A1 10/2016 Lestz et al.
2016/0319650 A1 11/2016 Oehring et al.
2016/0326854 A1 11/2016 Broussard et al.
2016/0326855 A1 11/2016 Coli et al.
2016/0341281 A1 11/2016 Brunvold et al.
2016/0348479 A1 12/2016 Oehring et al.
2016/0349728 A1 12/2016 Oehring et al.
2016/0369609 A1 12/2016 Morris et al.
2017/0016433 A1 1/2017 Chong et al.
2017/0021318 A1 1/2017 Mciver
2017/0022788 A1 1/2017 Oehring et al.
2017/0022807 A1 1/2017 Dursun et al.
2017/0028368 A1 2/2017 Oehring et al.
2017/0030177 A1 2/2017 Oehring et al.
2017/0030178 A1 2/2017 Oehring et al.
2017/0036178 A1 2/2017 Coli et al.
2017/0036872 A1 2/2017 Wallace
2017/0037717 A1 2/2017 Oehring et al.
2017/0037718 A1 2/2017 Coli et al.

(56) References Cited

U.S. PATENT DOCUMENTS

| | | | |
|---|---|---|---|
| 2017/0043280 | A1 | 2/2017 | Vankouwenberg |
| 2017/0051732 | A1 | 2/2017 | Hernandez et al. |
| 2017/0074076 | A1 | 3/2017 | Joseph et al. |
| 2017/0096885 | A1 | 4/2017 | Oehring et al. |
| 2017/0096889 | A1 | 4/2017 | Blanckaert et al. |
| 2017/0104389 | A1 | 4/2017 | Morris et al. |
| 2017/0114625 | A1 | 4/2017 | Norris et al. |
| 2017/0130743 | A1 | 5/2017 | Anderson |
| 2017/0138171 | A1 | 5/2017 | Richards et al. |
| 2017/0145918 | A1 | 5/2017 | Oehring et al. |
| 2017/0146189 | A1 | 5/2017 | Herman et al. |
| 2017/0159570 | A1 | 6/2017 | Bickert |
| 2017/0159654 | A1 | 6/2017 | Kendrick |
| 2017/0175516 | A1 | 6/2017 | Eslinger |
| 2017/0204852 | A1 | 7/2017 | Barnett, Jr. |
| 2017/0218727 | A1 | 8/2017 | Oehring et al. |
| 2017/0218843 | A1 | 8/2017 | Oehring et al. |
| 2017/0222409 | A1 | 8/2017 | Oehring et al. |
| 2017/0226838 | A1 | 8/2017 | Ciezobka et al. |
| 2017/0226839 | A1 | 8/2017 | Broussard et al. |
| 2017/0226842 | A1 | 8/2017 | Omont et al. |
| 2017/0234250 | A1 | 8/2017 | Janik |
| 2017/0241221 | A1 | 8/2017 | Seshadri et al. |
| 2017/0259227 | A1 | 9/2017 | Morris et al. |
| 2017/0292513 | A1 | 10/2017 | Haddad et al. |
| 2017/0313499 | A1 | 11/2017 | Hughes et al. |
| 2017/0314380 | A1 | 11/2017 | Oehring et al. |
| 2017/0314979 | A1 | 11/2017 | Ye et al. |
| 2017/0328179 | A1 | 11/2017 | Dykstra et al. |
| 2017/0369258 | A1 | 12/2017 | Degaray et al. |
| 2018/0028992 | A1 | 2/2018 | Stegemoeller et al. |
| 2018/0038216 | A1 | 2/2018 | Zhang et al. |
| 2018/0045331 | A1 | 2/2018 | Lopez et al. |
| 2018/0156210 | A1 | 6/2018 | Oehring et al. |
| 2018/0181830 | A1 | 6/2018 | Luharuka et al. |
| 2018/0183219 | A1 | 6/2018 | Oehring et al. |
| 2018/0216455 | A1 | 8/2018 | Andreychuk et al. |
| 2018/0238147 | A1 | 8/2018 | Shahri et al. |
| 2018/0245428 | A1 | 8/2018 | Richards |
| 2018/0258746 | A1 | 9/2018 | Broussard et al. |
| 2018/0266412 | A1 | 9/2018 | StokkevÅg et al. |
| 2018/0274446 | A1 | 9/2018 | Oehring et al. |
| 2018/0291713 | A1 | 10/2018 | Jeanson |
| 2018/0313677 | A1 | 11/2018 | Warren et al. |
| 2018/0320483 | A1 | 11/2018 | Zhang et al. |
| 2018/0343125 | A1 | 11/2018 | Clish et al. |
| 2018/0363437 | A1 | 12/2018 | Coli et al. |
| 2018/0363640 | A1 | 12/2018 | Kajita et al. |
| 2018/0366950 | A1 | 12/2018 | Pedersen et al. |
| 2019/0003329 | A1 | 1/2019 | Morris et al. |
| 2019/0010793 | A1 | 1/2019 | Hinderliter |
| 2019/0040727 | A1 | 2/2019 | Oehring et al. |
| 2019/0063309 | A1 | 2/2019 | Davis |
| 2019/0100989 | A1 | 4/2019 | Stewart et al. |
| 2019/0112910 | A1 | 4/2019 | Oehring et al. |
| 2019/0119096 | A1 | 4/2019 | Haile et al. |
| 2019/0120024 | A1 | 4/2019 | Oehring et al. |
| 2019/0128080 | A1 | 5/2019 | Ross et al. |
| 2019/0128104 | A1 | 5/2019 | Graham et al. |
| 2019/0145251 | A1 | 5/2019 | Johnson |
| 2019/0162061 | A1 | 5/2019 | Stephenson |
| 2019/0169971 | A1 | 6/2019 | Oehring et al. |
| 2019/0178057 | A1 | 6/2019 | Hunter |
| 2019/0178235 | A1 | 6/2019 | Coskrey et al. |
| 2019/0203567 | A1 | 7/2019 | Ross et al. |
| 2019/0203572 | A1 | 7/2019 | Morris et al. |
| 2019/0211661 | A1 | 7/2019 | Reckels et al. |
| 2019/0226317 | A1 | 7/2019 | Payne et al. |
| 2019/0245348 | A1 | 8/2019 | Hinderliter et al. |
| 2019/0257462 | A1 | 8/2019 | Rogers |
| 2019/0292866 | A1 | 9/2019 | Ross et al. |
| 2019/0292891 | A1 | 9/2019 | Kajaria |
| 2019/0316447 | A1 | 10/2019 | Oehring et al. |
| 2020/0040878 | A1 | 2/2020 | Morris |
| 2020/0047141 | A1 | 2/2020 | Oehring et al. |
| 2020/0088152 | A1 | 3/2020 | Alloin |
| 2020/0232454 | A1 | 7/2020 | Chretien et al. |
| 2020/0325760 | A1 | 10/2020 | Markham |
| 2020/0350790 | A1 | 11/2020 | Luft et al. |
| 2022/0029391 | A1 | 1/2022 | Ough |
| 2024/0060407 | A1 | 2/2024 | Oehring |
| 2025/0223896 | A1* | 7/2025 | Oehring ..... E21B 43/2607 |

FOREIGN PATENT DOCUMENTS

| | | |
|---|---|---|
| CA | 2707269 | 12/2010 |
| CA | 2482943 | 5/2011 |
| CA | 3050131 | 11/2011 |
| CA | 2955706 | 10/2012 |
| CA | 2966672 | 10/2012 |
| CA | 3000322 | 4/2013 |
| CA | 2787814 | 2/2014 |
| CA | 2833711 | 5/2014 |
| CA | 2978706 | 9/2016 |
| CA | 2944980 | 2/2017 |
| CA | 3006422 | 6/2017 |
| CA | 3018485 | 8/2017 |
| CA | 2964593 | 10/2017 |
| CA | 2849825 | 7/2018 |
| CA | 3067854 | 1/2019 |
| CA | 2919649 | 2/2019 |
| CA | 2919666 | 7/2019 |
| CA | 2797081 | 9/2019 |
| CA | 2945579 | 10/2019 |
| CN | 201687513 | 12/2010 |
| CN | 101977016 | 2/2011 |
| CN | 202023547 | 11/2011 |
| CN | 102602322 | 7/2012 |
| CN | 104117308 | 10/2014 |
| CN | 205986303 | 2/2017 |
| CN | 108049999 | 5/2018 |
| CN | 112196508 | 1/2021 |
| JP | 2004264589 | 9/2004 |
| WO | 2009046280 | 4/2009 |
| WO | 2014177346 | 11/2014 |
| WO | 2016144939 | 9/2016 |
| WO | 2016160458 | 10/2016 |
| WO | 2019210417 | 11/2019 |

OTHER PUBLICATIONS

Final Office Action mailed Mar. 3, 2020 issued in U.S. Appl. No. 16/152,695.

Luis Gamboa, "Variable Frequency Drives in Oil and Gas Pumping Systems", Dec. 17, 2011, 5 pages.

Non-Final Office Action mailed Mar. 31, 2020 issued in U.S. Appl. No. 15/356,436.

Office Action mailed Jun. 29, 2020 in related U.S. Appl. No. 16/404,283.

Schlumberger, "Jet Manual 23, Fracturing Pump Units, SPF/SPS-343, Version 1.0" Jan. 31, 2007, 68 pages.

Stewart & Stevenson, "Stimulation Systems," 2007, 20 pages.

USPTO, Notice of Allowance issued in U.S. Appl. No. 18/211,791 on Oct. 16, 2024, 8 pages.

Water and Glycol Heating Systems (https://www.heat-inc.com/wg-series-water-glycol-systems/) Jun. 18, 2018 (Jun. 18, 2018), entire document, especially WG Series Water Glycol Systems, 1 pages.

Canadian Office Action issued Sep. 8, 2020 in Candian Patent Application No. 2,928,707, 1 pages.

Albone, "Mobile Compressor Stations for Natural Gas Transmission Service," ASME 67-GT-33, Turbo Expo, Power for Land, Sea and Air, vol. 79887, p. 1-10, 1967, 10 pages.

Final Office Action issued in corresponding U.S. Appl. No. 15/145,491 dated Sep. 6, 2017., 10 pages.

Goodwin, "High-voltage auxiliary switchgear for power stations," Power Engineering Journal, 1989, 10 pg. (Year 1989), 10 pages.

International Search and Written Opinion Mailed Aug. 28, 2020 in PCT/US20/23821, 10 pages.

International Search Report and Written Opinion mailed Dec. 31, 2018 in related PCT Patent Application No. PCT/US18/55913, 10 pages.

(56) References Cited

OTHER PUBLICATIONS

International Search Report and Written Opinion mailed Feb. 11, 2020 in related PCT Application No. PCT/US2019/055323, 10 pages.
International Search Report and Written Opinion mailed Mar. 5, 2019 in related PCT Application No. PCT/US18/63970., 10 pages.
International Search Report and Written Opinion mailed Nov. 26, 2019 in related PCT Application No. PCT/US19/51018, 10 pages.
Non-Final Office Action issued in corresponding U.S. Appl. No. 14/622,532 dated May 17, 2016., 10 pages.
Non-Final Action issued in corresponding U.S. Appl. No. 15/293,681 dated Feb. 16, 2017., 10 pages.
Non-Final Office Action issued in Corresponding U.S. Appl. No. 15/145,491 on May 15, 2017., 10 pages.
Non-Final Office Action issued in corresponding U.S. Appl. No. 15/235,788 dated Dec. 14, 2016., 10 pages.
Non-Final Office Action mailed Dec. 6, 2019 in related U.S. Patent Application No. 16/564, 186., 10 pages.
Notice of Allowance and Notice of Allowability issued in U.S. Appl. No. 15/829,419 mailed Jul. 26, 2021, 10 pages.
Office Action mailed Jun. 11, 2019 in corresponding U.S. Appl. No. 16/210,749, 10 pages.
Dan T. Ton & Merrill A. Smith, The U.S. Department of Energy's Microgrid Initiative, 25 The Electricity J. 84 (2012), pp. 84-94., 11 pages.
International Search Report and Written Opinion mailed Jan. 4, 2019 in related PCT Patent Application No. PCT/US18/57539, 11 pages.
International Search Report and Written Opinion Mailed Sep. 3, 2020 in PCT/US2020/36932, 11 pages.
Non-Final Office Action issued in corresponding U.S. Appl. No. 14/622,532 dated Aug. 5, 2015, 11 pages.
Office Action mailed Oct. 2, 2019 in related U.S. Appl. No. 16/152,732, 11 pages.
Office Action mailed Sep. 20, 2019 in related U.S. Appl. No. 16/443,273, 11 pages.
Woodbury et al., "Electrical Design Considerations for Drilling Rigs," IEEE Transactions on Industry Applications, vol. 1A-12, No. 4, Jul./Aug. 1976, pp. 421-431, 11 pages.
Final Office Action issued in U.S. Appl. No. 16/356,263 mailed Oct. 7, 2021, 12 pages.
Non-Final Office Action issued in U.S. Appl. No. 17/060,647 mailed Sep. 20, 2021, 12 pages.
Non-Final Office Action mailed Jan. 10, 2020 in related U.S. Appl. No. 16/597,014, 12 pages.
Final Office Action issued in corresponding U.S. Appl. No. 14/622,532 dated Dec. 7, 2016., 13 pages.
Non-Final Office Action issued in U.S. Appl. No. 14/881,535 mailed Jul. 21, 2021, 13 pages.
Non-Final Office Action issued in U.S. Appl. No. 14/881,535 mailed May 20, 2020, 13 pages.
Non-Final Office Action issued in U.S. Appl. No. 16/458,696 mailed May 22, 2020, 13 pages.
Non-Final Office Mailed Oct. 5, 2020 in U.S. Appl. No. 16/443,273, 13 pages.
Notice of Allowance issued in corresponding U.S. Appl. No. 14/622,532 dated Mar. 27, 2017., 13 pages.
Kroposki et al., Making Microgrids Work, 6 IEEE Power and Energy Mag. 40, 41 (2008), 14 pages.
Non-Final Office Action issued Oct. 6, 2017 in related U.S. Appl. No. 14/881,535, 14 pages.
Office Action dated Apr. 10, 2018 in related U.S. Patent U.S. Appl. No. 15/294,349, 14 pages.
Non-Final Office Action issue din corresponding U.S. Appl. No. 15/291,842 dated Jan. 6, 2017., 15 pages.
Non-Final Office Action issued in U.S. Appl. No. 15/145,443 mailed May 8, 2020, 15 pages.
Non-Final Office Action mailed Dec. 23, 2019 in related U.S. Appl. No. 16/597,008., 15 pages.
Non-Final Office Action issued in corresponding U.S. Appl. No. 15/294,349 dated Mar. 14, 2017., 16 pages.
Non-final Office Action mailed Feb. 12, 2019 in related U.S. Appl. No. 16/170,695., 16 pages.
Non-Final Office Action Mailed Sep. 2, 2020 in U.S. Appl. No. 16/356,263, 16 pages.
Office Action mailed May 10, 2019 in corresponding U.S. Appl. No. 16/268,030, 16 pages.
Non-Final Office action Mailed Aug. 31, 2020 in U.S. Appl. No. 16/167,083, 17 pages.
Office Action mailed Sep. 11, 2019 in related U.S. Appl. No. 16/268,030, 18 pages.
Office Action mailed Jun. 7, 2019 in corresponding U.S. Appl. No. 16/170,695, 19 pages.
"Heat Exchanger" (https://en.wikipedia.org/w/index.php?title=Heat_exchanger&oldid=89300146) Dec. 18, 2019 Apr. 2019 (Apr. 18, 2019), entire document, especially para (0001], 21 pages.
Office Action mailed Aug. 19, 2019 in related U.S. Appl. No. 15/356,436, 22 pages.
Final Office Action issued in corresponding U.S. Appl. No. 15/294,349 dated Jul. 6, 2017,, 23 pages.
Karin, "Duel Fuel Diesel Engines," (2015), Taylor & Francis, pp. 62-63, Retrieved from https://app.knovel.com/hotlink/toc/id:kpDFDE0001/dual-fueal-diesel-engines/duel-fuel-diesel-engines (Year 2015), 23 pages.
Non-Final Office Mailed Oct. 26, 2020 in U.S. Appl. No. 15/356,436, 23 pages.
Non-Final Office Action issued in corresponding U.S. Appl. No. 15/487,656 dated Jun. 23, 2017., 26 pages.
Non-Final Office Action issued in corresponding U.S. Appl. No. 15/487,694 dated Jun. 26, 2017., 27 pages.
Non-Final Office Action issued in corresponding U.S. Appl. No. 15/486,970 dated Jun. 22, 2017., 28 pages.
Non-Final Office Action issued in corresponding U.S. Appl. No. 14/884,363 dated Sep. 5, 2017., 29 pages.
Non-Final Office Action issued Nov. 13, 2017 in related U.S. Appl. No. 15/644,487., 29 pages.
Canadian Office Action dated Sep. 28, 2018 in related Canadian Patent Application No. 2,945,281., 3 pages.
Canadian Office Action issued Sep. 22, 2020 in Canadian Application No. 2,982,974, 3 pages.
Canadian Office Action mailed Oct. 1, 2019 in related Canadian Patent Application No. 2,936,997, 3 pages.
Office Action mailed Jan. 30, 2019 in related Canadian Patent Application No. 2,936,997., 3 pages.
"Process Burner" (https://www.cebasrt.com/productsloii-gaslprocess-burner) Sep. 6, 06, 2018 (06.09.2018), entire document, especially para (Burners for refinery Heaters), 4 pages.
Canadian Office Action dated Jun. 22, 2018 in related Canadian Patent Application No. 2,886,697, 4 pages.
Canadian Office Action dated Mar. 2, 2018 in related Canadian Patent Application No. 2,833,711., 4 pages.
Canadian Office Action issued Aug. 31, 2020 in Candian Patent Application No. 2,944,980, 4 pages.
Canadian Office Action mailed Aug. 17, 2020 in related CA Patent Application No. 2,944,968, 4 pages.
Canadian Office Action mailed Aug. 18, 2020 in related CA Patent Application No. 2,933,444, 4 pages.
Canadian Office Action mailed Jun. 20, 2019 in corresponding CA Application No. 2,964,597, 4 pages.
Office Action mailed Mar. 1, 2019 in related Canadian Patent Application No. 2,943,275., 4 pages.
Canadian Office Action issued in Canadian Application No. 3,094,768 mailed Oct. 28, 2021., 5 pages.
Canadian Office Action mailed May 30, 2019 in corresponding CA Application No. 2,833,711, 5 pages.
Notice of Allowance issued in corresponding U.S. Appl. No. 15/217,040 dated Mar. 28, 2017., 5 pages.
Canadian Office Action dated Apr. 18, 2018 in related Canadian Patent Application No. 2,298,711, 6 pages.
International Search Report and Written Opinion mailed in PCT/US2020/066543 mailed Mar. 11, 2021, 6 pages.

(56) References Cited

OTHER PUBLICATIONS

Non-Final Office Action issued in U.S. Appl. No. 16/871,928 mailed Aug. 25, 2021, 6 pages.
Non-Final Office Action issued in U.S. Appl. No. 16/943,935 mailed Oct. 21, 2021, 6 pages.
International Search Report and Written Opinion mailed Feb. 15, 2019 in related PCT Application No. PCT/US18/63977., 7 pages.
International Search Report and Written Opinion mailed in PCT/US20/67523 mailed Mar. 22, 2021, 7 pages.
International Search Report and Written Opinion mailed in PCT/US20/67528 mailed Mar. 19, 2021., 7 pages.
International Search Report and Written Opinion mailed Sep. 11, 2019 in related PCT Application No. PCT/US2019/037493, 7 pages.
Non-Final Office Action issued in corresponding U.S. Appl. No. 15/145,491 on Sep. 12, 2016, 7 pages.
Non-Final Office Action issued in U.S. Appl. No. 16/901,774 mailed Sep. 14, 2021, 7 pages.
Office Action dated Jul. 25, 2018 in related U.S. Appl. No. 15/644,487, 7 pages.
Office Action dated May 29, 2018 in related U.S. Appl. No. 15/235,716, 7 pages.
Office Action mailed Dec. 12, 2018 in related U.S. Appl. No. 16/160,708, 7 pages.
Office Action mailed Oct. 11, 2019 in related U.S. Appl. No. 16/385,070, 7 pages.
Final Office Action issued in corresponding U.S. Appl. No. 15/145,491 dated Jan. 20, 2017., 8 pages.
International Search and Report and Written Opinion mailed Jan. 2, 2019 in related PCT Patent Application No. PCT/US18/54542, 8 pages.
International Search report and Written Opinion dated Sep. 19, 2018 in related PCT Patent Application No. PCT/US2018/040683., 8 pages.
International Search Report and Written Opinion issued in PCT/US2020/023809 mailed Jun. 2, 2020., 8 pages.
International Search Report and Written Opinion mailed Apr. 10, 2019 in corresponding PCT Application No. PCT/US2019/016635, 8 pages.
International Search Report and Written Opinion mailed in PCT/US20/67146 mailed Mar. 29, 2021, 8 pages.
International Search Report and Written Opinion mailed in PCT/US20/67608 mailed Mar. 30, 2021, 8 pages.
Non-Final Office Action issued in corresponding U.S. Appl. No. 15/217,040 dated Nov. 29, 2016., 8 pages.
Non-Final Office Action issued in U.S. Appl. No. 16/404,283 mailed Jul. 21, 2021, 8 pages.
Non-Final Office Action issued in US Patent Application No. 16/564, 186, mailed Oct. 15, 2021, 8 pages.
Non-Final Office Action issued Nov. 29, 2017 in related U.S. Appl. No. 15/145,414, 8 pages.
Non-Final Office Action mailed Mar. 6, 2019 in related U.S. Appl. No. 15/183,387., 8 pages.
Non-Final Office Action Mailed Sep. 29, 2020 in U.S. Appl. No. 16/943,727, 8 pages.
Office Action dated Apr. 2, 2018 in related U.S. Appl. No. 15/183,387, 8 pages.
Office Action mailed Aug. 4, 2020 in related U.S. Appl. No. 16/385,070, 8 pages.
Office Action mailed Jun. 22, 2020 in relate U.S. Appl. No. 16/377,861, 8 pages.
Office Action mailed Jun. 29, 2020 in related U.S. Appl. No. 16/728,359, 8 pages.
USPTO, Non-Final Office Action issued in U.S. Appl. No. 18/211,791 on Jul. 1, 2024, 80 pages.
Final Office Action issued in corresponding U.S. Appl. No. 14/622,532 dated Dec. 21, 2015, 9 pages.
International Search Report and Written Opinion mailed in PCT/US20/67526 mailed May 6, 2021, 9 pages.
International Search Report and Written Opinion mailed Jan. 2, 2019 in related PCT Patent Application No. PCT/US18/54548, 9 pages.
International Search Report and Written Opinion mailed Jan. 2, 2020 in related PCT Application No. PCT/US19/55325, 9 pages.
International Search Report and Written Opinion mailed Jul. 22, 2020 in corresponding PCT Application No. PCT/US20/00017, 9 pages.
International Search Report and Written Opinion mailed Jul. 9, 2019 in corresponding PCT Application No. PCT/US2019/027584, 9 pages.
International Search Report and Written Opinion mailed Jun. 23, 2020 in corresponding PCT Application No. PCT/US20/23912, 9 pages.
Non-Final Office Action issued in corresponding U.S. Appl. No. 15/145,443 dated Feb. 7, 2017., 9 pages.
Non-Final Office Action issued in U.S. Appl. No. 16/943,727 mailed Aug. 3, 2021, 9 pages.
Non-Final Office Action issued in U.S. Appl. No. 16/871,328 mailed Dec. 9, 2021, 9 pages.
Non-Final Office Action mailed Feb. 25, 2019 in related U.S. Appl. No. 16/210,749., 9 pages.
Notice Of Allowance mailed Apr. 23, 2019 in corresponding U.S. Appl. No. 15/635,028, 9 pages.
Notice of Allowance mailed Jan. 9, 2020 in related U.S. Appl. No. 16/570,331., 9 pages.
Office Action dated Oct. 4, 2018 in related U.S. Appl. No. 15/217,081, 9 pages.
Office Action mailed Sep. 3, 2019 in related U.S. Appl. No. 15/994,772, 9 pages.
UK Power Networks, "Transformers to Supply Heat to Tate Modern", UK Power Networks, from press releases May 16, 2013, 2 pages.

* cited by examiner

CABLE MANAGEMENT OF ELECTRIC POWERED HYDRAULIC FRACTURING PUMP UNIT

CROSS REFERENCE TO RELATED APPLICATIONS

This application is a continuation of U.S. patent application Ser. No. 18/211,791 filed Jun. 20, 2023, which is a continuation of U.S. patent application Ser. No. 17/202,412 filed Mar. 16, 2021, now U.S. Pat. No. 11,680,473 issued Jun. 20, 2023, which is a continuation of U.S. patent application Ser. No. 16/047,653 filed Jul. 27, 2018, now U.S. Pat. No. 10,947,829 issued Mar. 16, 2021, which is a continuation of U.S. patent application Ser. No. 15/145,491 filed May 3, 2016, now U.S. Pat. No. 10,036,238 issued Jul. 31, 2018, which claims priority to and the benefit of, U.S. Provisional Application Ser. No. 62/156,303, filed May 3, 2015 and is a continuation-in-part of, and claims priority to and the benefit of U.S. patent application Ser. No. 13/679,689 filed Nov. 16, 2012, now U.S. Pat. No. 9,410,410 issued Aug. 9, 2016, the full disclosures of which are hereby incorporated by reference herein for all purposes.

BACKGROUND OF THE INVENTION

1. Field of Invention

The present disclosure relates to hydraulic fracturing of subterranean formations. In particular, the present disclosure relates to electrical components and connections connected to an electric hydraulic fracturing pump to minimize space and time requirements for rig up and rig down.

2. Description of Prior Art

Hydraulic fracturing is a technique used to stimulate production from some hydrocarbon producing wells. The technique usually involves injecting fluid into a wellbore at a pressure sufficient to generate fissures in the formation surrounding the wellbore. Typically the pressurized fluid is injected into a portion of the wellbore that is pressure isolated from the remaining length of the wellbore so that fracturing is limited to a designated portion of the formation. The fracturing fluid slurry, whose primary component is usually water, includes proppant (such as sand or ceramic) that migrate into the fractures with the fracturing fluid slurry and remain to prop open the fractures after pressure is no longer applied to the wellbore. Other primary fluids sometimes used for the slurry include nitrogen, carbon dioxide, foam, diesel, or other fluids. A typical hydraulic fracturing fleet may include a data van unit, blender unit, hydration unit, chemical additive unit, hydraulic fracturing pump unit, sand equipment, electric wireline, and other equipment.

Traditionally, the fracturing fluid slurry has been pressurized on surface by high pressure pumps powered by diesel engines. To produce the pressures required for hydraulic fracturing, the pumps and associated engines have substantial volume and mass. Heavy duty trailers, skids, or trucks are required for transporting the large and heavy pumps and motors to sites where wellbores are being fractured. Each hydraulic fracturing pump usually includes power and fluid ends, as well as seats, valves, springs, and keepers internally. These parts allow the hydraulic fracturing pump to draw in low pressure fluid slurry (at approximately 100 psi) and discharge the same fluid slurry at high pressures (up to 15,000 psi or more). Recently electrical motors have been introduced to replace the diesel motors, which greatly reduces the noise generated by the equipment during operation. After being transported to a wellsite electrically powered fracturing equipment, i.e. motors for pressurizing fracturing and hydraulic fluids, are connected to electrical power sources. Electrical connection for this equipment is time consuming, and the current electrical distribution configurations require numerous cables that occupy valuable space.

SUMMARY OF THE INVENTION

Disclosed herein is an example of a hydraulic fracturing system for fracturing a subterranean formation, and which includes first and second pumps, first and second motors for driving the first and second pumps, a transformer, a first electrical circuit between the first motor and the transformer, and through which the first motor and transformer are in electrical communication, and a second electrical circuit that is separate and isolated from the first electrical circuit, and that is between the second motor and the transformer, and through which the second motor and transformer are in electrical communication. A cable assembly can be included which has an electrically conducting cable, a transformer end plug on one end of the cable and in electrical communication with the cable, and a motor end plug on an end of the cable distal from the transformer end plug and that is in electrical communication with the cable. A transformer receptacle can further be included that is in electrical communication with the transformer, and a motor receptacle in electrical communication with a one of the first or second motors, so that when the transformer end plug is inserted into the transformer receptacle, and the motor end plug is inserted into the motor receptacle, the transformer and a one of the first or second motors are in electrical communication, and wherein the plugs are selectively withdrawn from the receptacles. The hydraulic fracturing system can further include a multiplicity of cable assemblies, transformer receptacles, and motor receptacles, wherein three phase electricity is transferred between the transformer and the first or second motors in different cables. The receptacles can be strategically arranged so that cable assemblies that conduct electricity at the same phase are adjacent one another. A transformer ground receptacle can further be included that is in electrical communication with a ground leg of the transformer, and a pump ground receptacle in electrical communication with a ground leg of one of the first or second pumps, so that when the transformer ground plug is inserted into the transformer ground receptacle, and the pump ground plug is inserted into the pump receptacle, the transformer ground leg and the ground leg of one of the first or second pumps are in electrical communication, and wherein the plugs are selectively withdrawn from the receptacles. The hydraulic fracturing system can also include a platform on which the first and second pumps and motors are mounted, an enclosure on the platform, one or more variable frequency drives coupled with one or more of the motors and within the enclosure, and a removable panel on the enclosure adjacent the variable frequency drive, so that by removing the panel the variable frequency drive is easily accessible.

Another example of a hydraulic fracturing system for fracturing a subterranean formation includes a source of electricity, a row of source receptacles that are in electrical communication with the source of electricity and configured so that some of the source receptacles receive electricity from the source of electricity at a phase that is different from a phase of electricity received by other source receptacles from the source of electricity, an electrically powered motor that is spaced apart from the source of electricity, a row of motor receptacles that are in electrical communication with the motor, and cable assemblies. The cable assemblies include a source plug that is selectively insertable into a one of the source receptacles, a motor plug that is selectively insertable into a one of the motor receptacles, and a cable in electrical communication with both the source plug and motor plug, so that when the source plug inserts into a one of the source receptacles, and the motor plug inserts into the a one of the motor receptacles, electricity at a designated phase is transmitted from the source of electricity to the variable frequency drive to operate and control a motor. The source of electricity can be a transformer having alternating current electricity at three different phases. In an example, the motor is a first motor, the system further having a second motor, and wherein the first and second motors each drive fracturing pumps. In an embodiment, electricity conducts from the source of electricity to the first motor along a first path, wherein electricity conducts from the source of electricity to the second motor along a second path, and wherein the first and second paths are separate and distinct from one another. In another embodiment, electricity conducts from the source of electricity to a single variable frequency drive which supplies power to a single motor which turns more than one hydraulic fracturing pump. A first pair of the source receptacles can receive electricity at a first phase, so that a corresponding first pair of cable assemblies that have source plugs inserted into the source receptacles conduct electricity at the first phase, wherein a second pair of the source receptacles receive electricity at a second phase, so that a corresponding second pair of cable assemblies that have source plugs inserted into the source receptacles conduct electricity at the second phase, and wherein a third pair of the source receptacles receive electricity at a third phase, so that a corresponding third pair of cable assemblies that have source plugs inserted into the source receptacles conduct electricity at the third phase.

A method of hydraulic fracturing is described herein and that includes electrically connecting a fracturing pump motor with a source of electricity by inserting a source end of a cable assembly into a source receptacle that is in electrical communication with the source of electricity and inserting a motor end of the cable assembly, which is in electrical communication with the source end of the cable assembly, into a motor receptacle that is in electrical communication with variable frequency drive, which is in electrical communication with the motor, which is in mechanical communication with the hydraulic fracturing pump that discharges high pressure hydraulic fracturing fluid slurry to the wellbore. The source of electricity transmits electricity to the source receptacle, so that electricity conducts from the source receptacle, to the motor receptacle, to the variable frequency drive, and to the motor. The source of electricity can be a transformer that transmits 3-phase electricity. In an embodiment, the fracturing pump motor includes a first fracturing pump motor, and wherein the cable assembly comprises a first cable assembly, the method further comprising repeating the steps of electrically connecting a fracturing pump motor with a source of electricity by inserting a source end of a cable assembly into a source receptacle that is in electrical communication with the source of electricity and inserting a motor end of the cable assembly, which is in electrical communication with the source end of the cable assembly, into a motor receptacle that is in electrical communication with the fracturing pump motor, directing fracturing fluid to a suction end of a fracturing pump that is coupled with the fracturing pump motor, and causing the source of electricity to transmit electricity to the source receptacle, so that electricity conducts from the source receptacle, to the source and motor ends, to the motor receptacle, and to the motor using a second fracturing pump motor and a second cable assembly. The method can also include removing the ends of the cable assembly from the receptacles, moving the source of electricity and fracturing pump motor to a different location, and repeating the steps of electrically connecting a fracturing pump motor with a source of electricity by inserting a source end of a cable assembly into a source receptacle that is in electrical communication with the source of electricity and inserting a motor end of the cable assembly, which is in electrical communication with the source end of the cable assembly, into a motor receptacle that is in electrical communication with the fracturing pump motor, directing fracturing fluid to a suction end of a fracturing pump that is coupled with the fracturing pump motor, and causing the source of electricity to transmit electricity to the source receptacle, so that electricity conducts from the source receptacle, to the source and motor ends, to the motor receptacle, and to the motor. The method can optionally further include repeating the step of electrically connecting a fracturing pump motor with a source of electricity by inserting a source end of a cable assembly into a source receptacle that is in electrical communication with the source of electricity and inserting a motor end of the cable assembly, which is in electrical communication with the source end of the cable assembly, into a motor receptacle that is in electrical communication with the fracturing pump motor, so that multiple cable assemblies are connected between multiple source receptacles and multiple motor receptacles, so that electricity at different phases is conducted through the different cable assemblies to the fracturing pump motor. Optionally, a path of electricity between the source of electricity and the first fracturing pump motor is separate and distinct from a path of electricity between the source of electricity and the second fracturing pump motor.

BRIEF DESCRIPTION OF DRAWINGS

Some of the features and benefits of the present invention having been stated, others will become apparent as the description proceeds when taken in conjunction with the accompanying drawings, in which.

Figure 1:
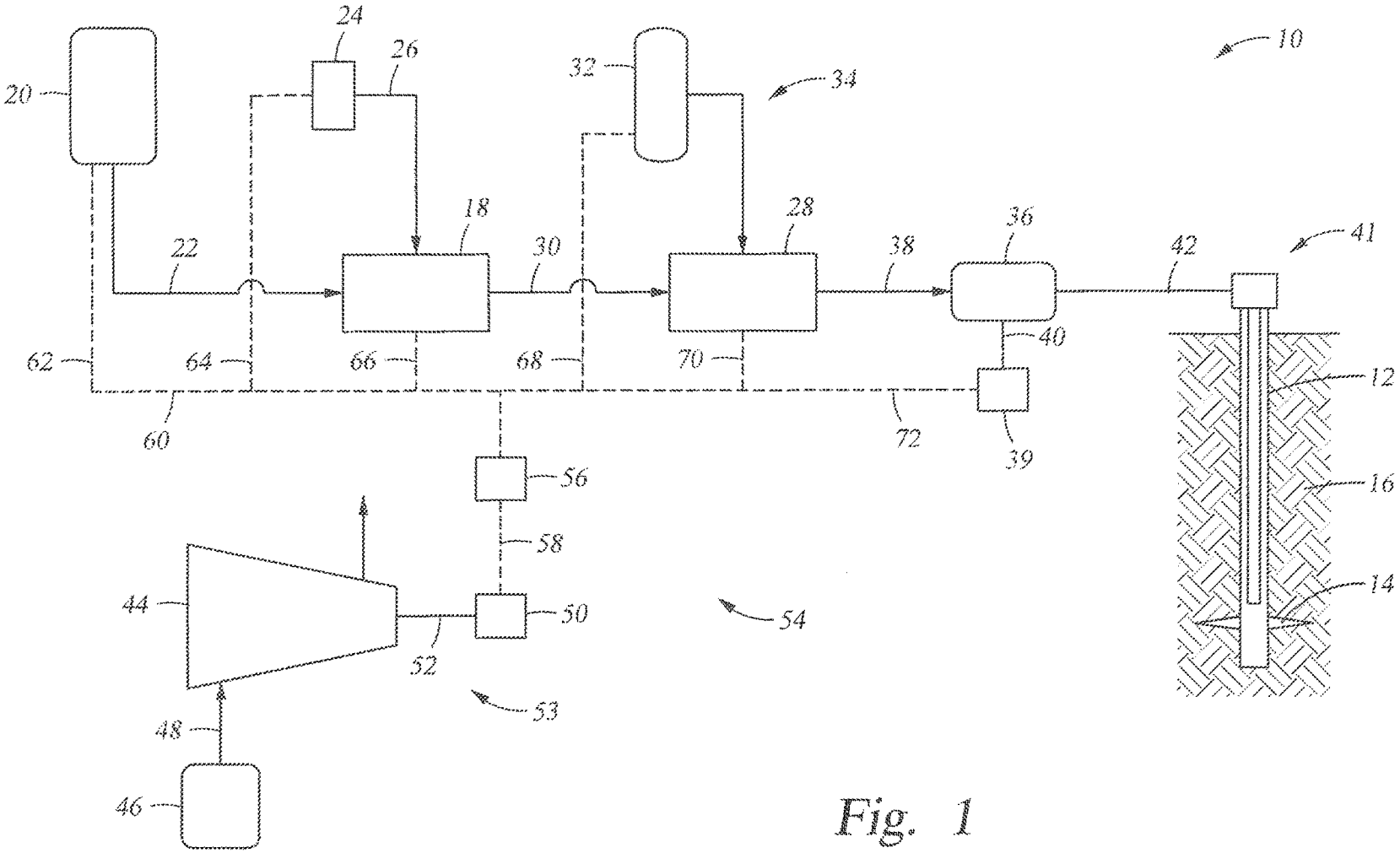
FIG. 1 is a schematic of an example of a hydraulic fracturing system.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a schematic example of a hydraulic fracturing system 10 that is used for pressurizing a wellbore 12 to create fractures 14 in a subterranean formation 16 that surrounds the wellbore 12. Included with the system 10 is a hydration unit 18 that receives fluid from a fluid source 20 via line 22, and also selectively receives additives from an additive source 24 via line 26. Additive source 24 can be separate from the hydration unit 18 as a stand-alone unit, or can be included as part of the same unit as the hydration unit 18. The fluid, which in one example is water, is mixed inside of the hydration unit 18 with the additives. In an embodiment, the fluid and additives are mixed over a period of time to allow for uniform distribution of the additives within the fluid. In the example of FIG. 1, the fluid and additive mixture is transferred to a blender unit 28 via line 30. A proppant source 32 contains proppant, which is delivered to the blender unit 28 as represented by line 34, where line 34 can be a conveyer. Inside the blender unit 28, the proppant and fluid/additive mixture are combined to form a fracturing slurry, which is then transferred to a fracturing pump system 36 via line 38; thus fluid in line 38 includes the discharge of blender unit 28 which is the suction (or boost) for the fracturing pump system 36. Blender unit 28 can have an onboard chemical additive system, such as with chemical pumps and augers (not shown). Optionally, additive source 24 can provide chemicals to blender unit 28; or a separate and standalone chemical additive system (not shown) can be provided for delivering chemicals to the blender unit 28. In an example, the pressure of the slurry in line 38 ranges from around 80 psi to around 100 psi. The pressure of the slurry can be increased up to around 15,000 psi by pump system 36. A motor 39, which connects to pump system 36 via connection 40, drives pump system 36 so that it can pressurize the slurry. In one example, the motor 39 is controlled by a variable frequency drive ("VFD"). After being discharged from pump system 36, slurry is injected into a wellhead assembly 41; discharge piping 42 connects discharge of pump system 36 with wellhead assembly 41 and provides a conduit for the slurry between the pump system 36 and the wellhead assembly 41. In an alternative, hoses or other connections can be used to provide a conduit for the slurry between the pump system 36 and the wellhead assembly 41. Optionally, any type of fluid can be pressurized by the fracturing pump system 36 to form a fracturing fluid that is then pumped into the wellbore 12 for fracturing the formation 16, and is not limited to fluids having chemicals or proppant. Examples exist wherein the system 10 includes multiple pumps 36, and multiple motors 39 for driving the multiple pumps 36. Examples also exist wherein the system 10 includes the ability to pump down equipment, instrumentation, or other retrievable items through the slurry into the wellbore.

An example of a turbine 44 is provided in the example of FIG. 1 and which receives a combustible fuel from a fuel source 46 via a feed line 48. In one example, the combustible fuel is natural gas, and the fuel source 46 can be a container of natural gas or a well (not shown) proximate the turbine 44. Combustion of the fuel in the turbine 44 in turn powers a generator 50 that produces electricity. Shaft 52 connects generator 50 to turbine 44. The combination of the turbine 44, generator 50, and shaft 52 define a turbine generator 53. In another example, gearing can also be used to connect the turbine 44 and generator 50. An example of a micro-grid 54 is further illustrated in FIG. 1, and which distributes electricity generated by the turbine generator 53. Included with the micro-grid 54 is a transformer 56 for stepping down voltage of the electricity generated by the generator 50 to a voltage more compatible for use by electrical powered devices in the hydraulic fracturing system 10. In another example, the power generated by the turbine generator and the power utilized by the electrical powered devices in the hydraulic fracturing system 10 are of the same voltage, such as 4160 V so that main power transformers are not needed. In one embodiment, multiple 3500 kVA dry cast coil transformers are utilized. Electricity generated in generator 50 is conveyed to transformer 56 via line 58. In one example, transformer 56 steps the voltage down from 13.8 kV to around 600 V. Other example step down voltages include 4,160 V, 480 V, or other voltages. The output or low voltage side of the transformer 56 connects to a power bus 60, lines 62, 64, 66, 68, 70, and 72 connect to power bus 60 and deliver electricity to electrically powered end users in the system 10. More specifically, line 62 connects fluid source 20 to bus 60, line 64 connects additive source 24 to bus 60, line 66 connects hydration unit 18 to bus 60, line 68 connects proppant source 32 to bus 60, line 70 connects blender unit 28 to bus 60, and line 72 connects motor 39 to bus 60. In an example, additive source 24 contains ten or more chemical pumps for supplementing the existing chemical pumps on the hydration unit 18 and blender unit 28. Chemicals from the additive source 24 can be delivered via lines 26 to either the hydration unit 18 and/or the blender unit 28. In one embodiment, the elements of the system 10 are mobile and can be readily transported to a wellsite adjacent the wellbore 12, such as on trailers or other platforms equipped with wheels or tracks.

Figure 2:
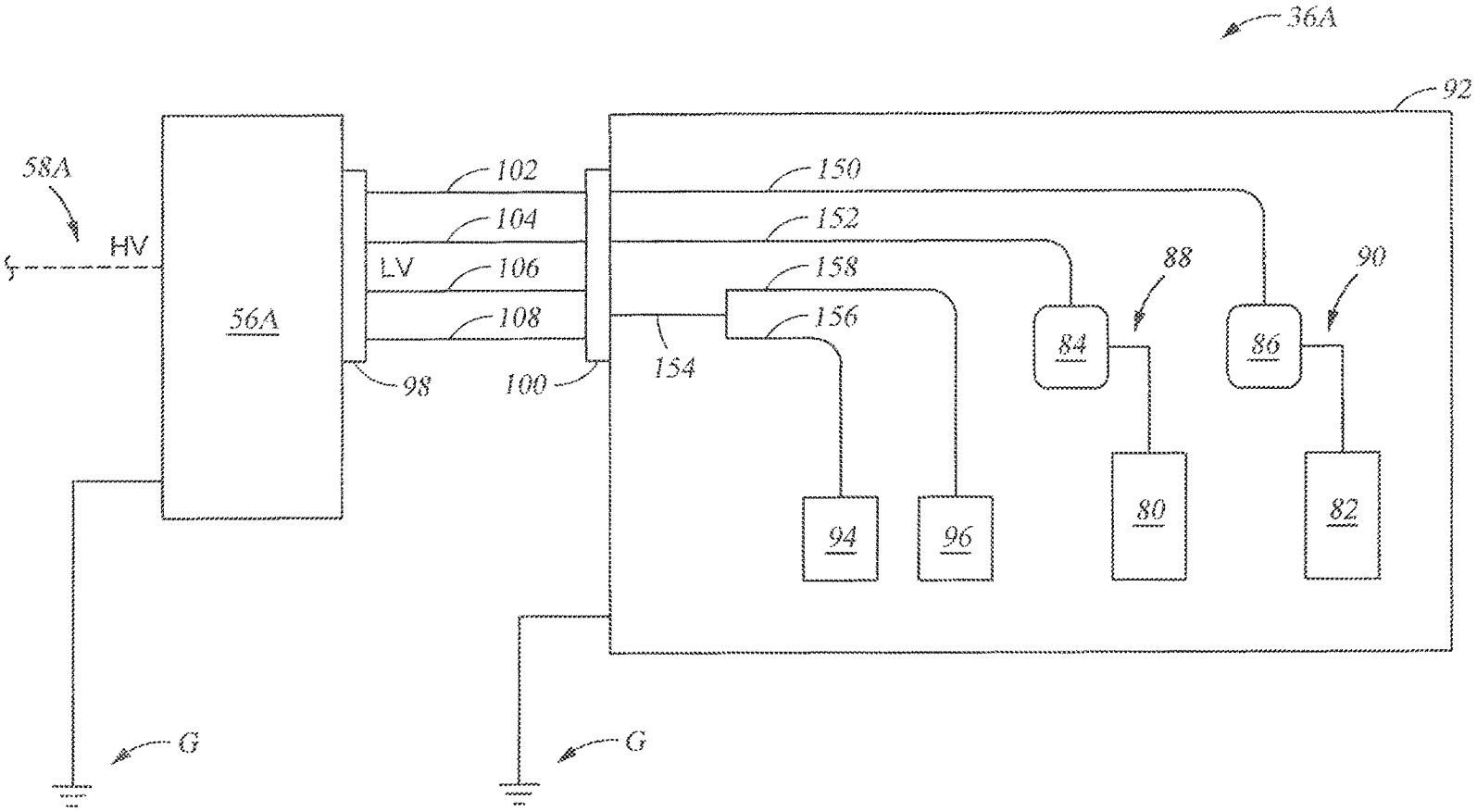
FIG. 2 is schematic of an example of electrical communication between a transformer and fracturing pump system of the hydraulic fracturing system of FIG. 1.

Schematically illustrated in FIG. 2 is one example of a fracturing pump system 36A having pumps 80, 82 that are respectively powered by motors 84, 86. Couplings 88, 90 mechanically affix the pumps 80, 82 with motors 84, 86 so that when motors 84, 86 are energized, the motors 84, 86 will drive pumps 80, 82 for pressurizing fracturing fluid that is then delivered to the wellbore 12 (FIG. 1). In this example, the fracturing pump system 36A is mounted on a trailer 92 which provides a mobile surface for transporting components of the fracturing pump system 36A to and from designated locations. Thus when operations at a wellsite are deemed complete, the fracturing pump system 36A can be transported to another wellsite for subsequent operations, or to a facility for repair or maintenance. Also schematically represented on trailer 92 and as part of the fracturing pump system 36A, are a motor control center 94 and auxiliary components 96. Examples of auxiliaries include heaters for the motors 84, 86, lights on the fracturing pump system 36A, control power for a variable frequency drive (not shown), heater for lube oil for pumps 80, 82, air blowers (not shown) for motors 84, 86, a hydraulic pump motor, and a hydraulic cooler motor (not shown). Not shown are variable frequency drives to control and operate motors 84, 86. In another embodiment, a single variable frequency drive controls and operates a single motor 84 which turns one or more hydraulic fracturing pumps (80 and 82).

Also shown in FIG. 2 is an example of transformer 56A having a high voltage side HV connected to line 58A; junction boxes 98, 100 respectively mounted on transformer 56A and fracturing pump system 36A provide means for electrical communication between transformer 56A and fracturing pump system 36A. Junction box 98 is mounted on a low voltage side LV of the transformer 56A As will be described in more detail below, junction boxes 98, 100 are equipped with quick disconnect receptacles so that lines having conductive wires and that conduct electricity between transformer 56A and fracturing pump system 36A, can be easily inserted and removed by operations personnel to significantly reduce the time required for assembly and disassembly of the hydraulic fracturing system 10. The electrically conducting lines between junction boxes 98, 100 include wire bundles 102, 104, which as will be described below each include a number of wires within and that are separable and distinct from one another. Wire bundles 102, 104 conduct electrical power from transformer 56A and to junction box 100 and which is used for energizing motors 84, 86. Also extending between junction boxes 98, 100 is line 106 and which conducts electricity that is used for powering the motor control center 94 and auxiliary components 96. Also extending between junction boxes 98, 100 is line 108 which is used as a ground between the transformer 56A and the hydraulic fracturing pump unit 36A. In one embodiment, the power generated is of the same voltage as the power supplied to the hydraulic fracturing pump unit 36. In this case, power for the hydraulic fracturing pump unit 36 is supplied directly without needing a transformer 56.

Figure 3:
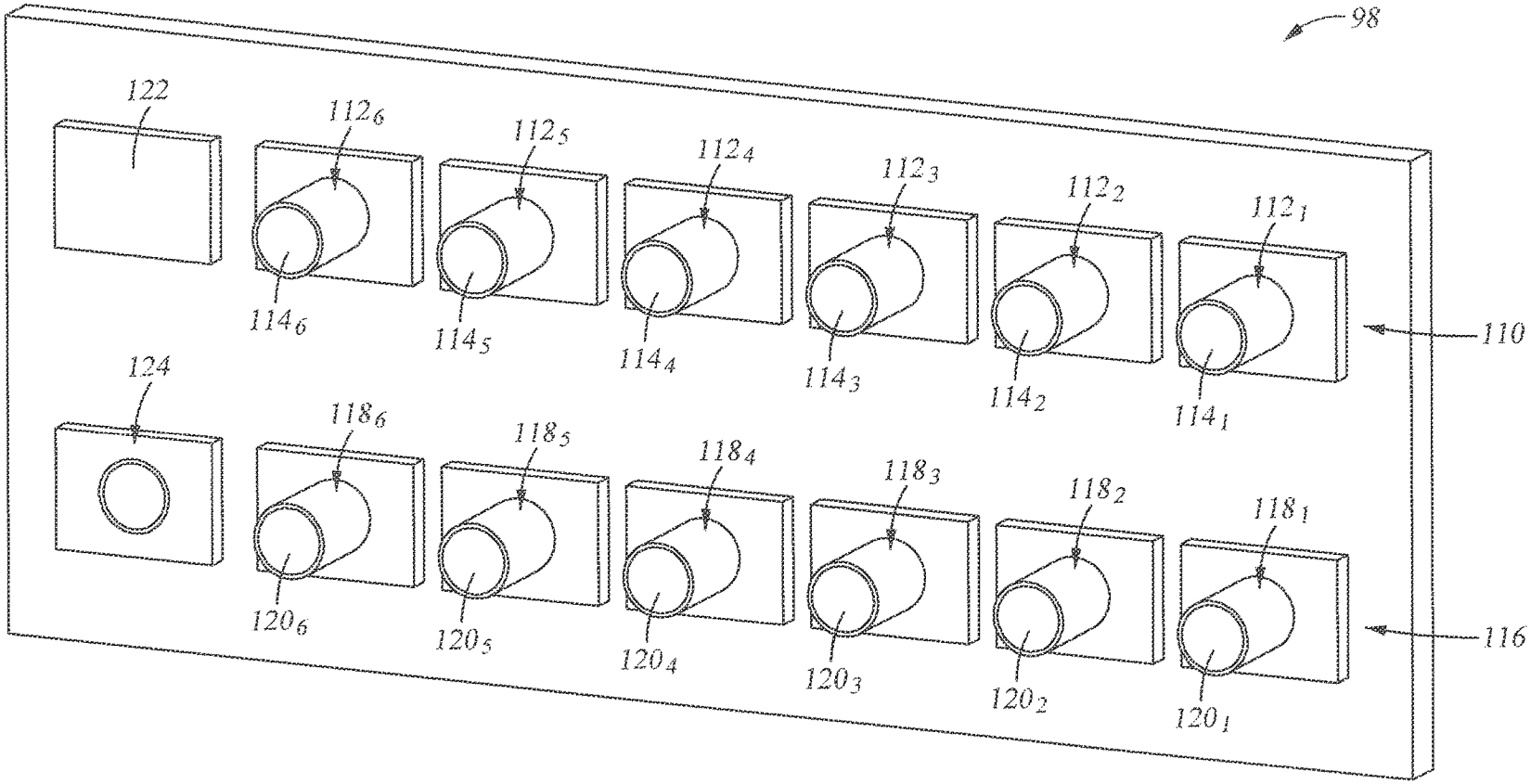
FIG. 3 is an end perspective views of an example of a junction box on the transformer of FIG. 2.

FIG. 3 shows an end perspective view of an example of junction box 98 and having a row 110 of receptacles $\mathbf{112}_1$-$\mathbf{112}_6$. The receptacles $\mathbf{112}_1$-$\mathbf{112}_6$ are each equipped with an opening $\mathbf{114}_1$-$\mathbf{114}_6$ in which an electrical conducting plug can be readily inserted and removed thereby providing electrical communication between the plug and attached conducting lead (such as a cable). Set below and extending generally parallel with row 110 is row 116 which also includes receptacles $\mathbf{118}_1$-$\mathbf{118}_6$, wherein the receptacles $\mathbf{118}_1$-$\mathbf{118}_6$ are each equipped with openings $\mathbf{120}_1$-$\mathbf{120}_6$ for receiving an electrically conducting plug. Set adjacent receptacle $\mathbf{112}_6$ is a ground connection 122 which connects to ground leads within transformer 56A (FIG. 2). Below ground connection 122 is an auxiliary/MCC connection 124, which provides a source of electrical power for the auxiliary components 96 and motor control center 94 (FIG. 2). In another embodiment, the receptacles can be arranged in different patterns and configurations.

Figure 4:
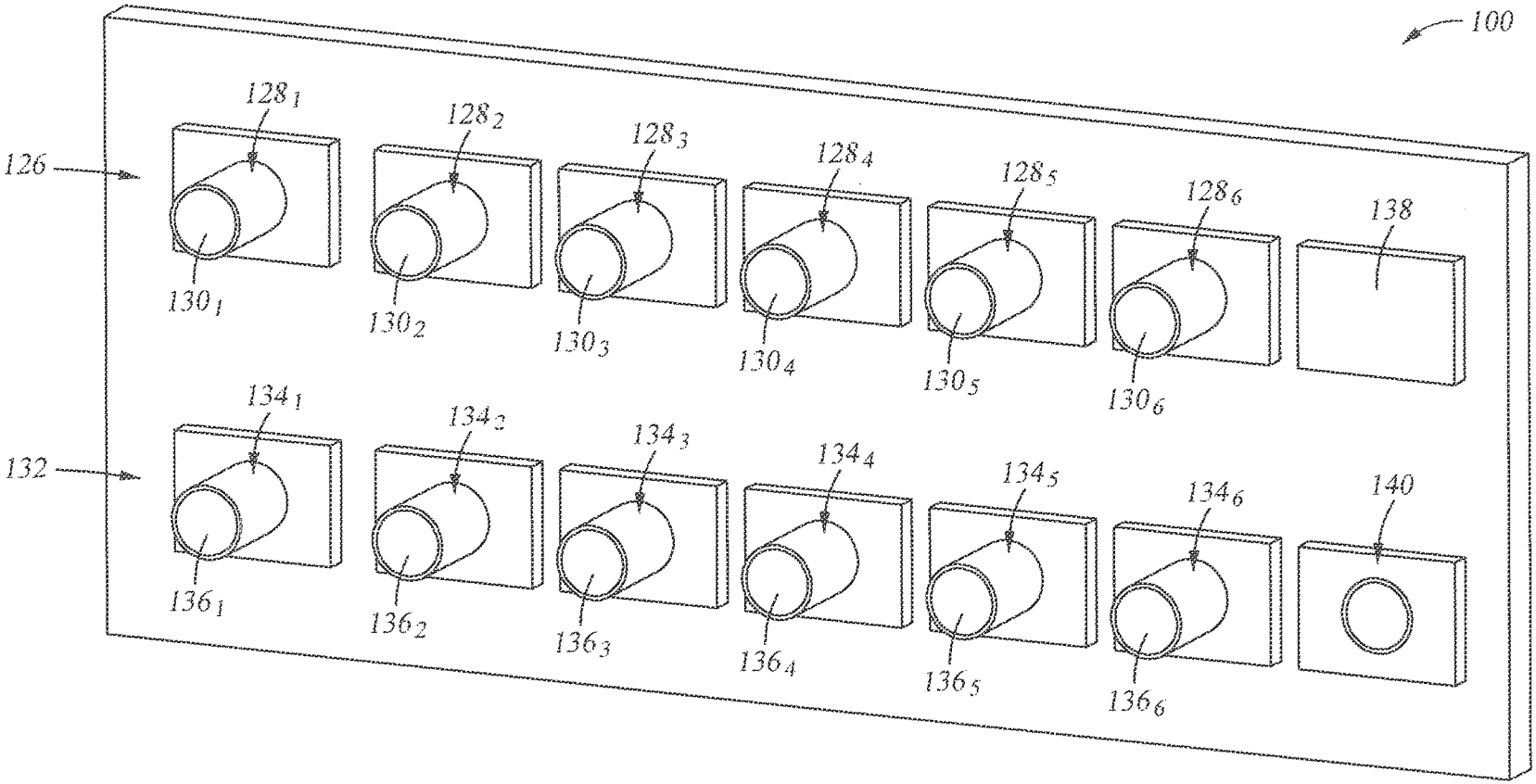
FIG. 4 is an end perspective views of an example of a junction box on the fracturing pump system of FIG. 2.

FIG. 4 shows an end perspective view of one example of junction box 100 which includes a row 126 of receptacles $\mathbf{128}_1$-$\mathbf{128}_6$, wherein the receptacles each have an opening $\mathbf{130}_1$-$\mathbf{130}_6$ on their ends distal from where they mount to junction box 100. Parallel with and set below row 126 is row 132, which is made up of a line of receptacles $\mathbf{134}_1$-$\mathbf{134}_6$ each having openings $\mathbf{136}_1$-$\mathbf{136}_6$. Also included with junction box 100 is a ground connection 138 and an auxiliary/MCC connection 140. In another embodiment, the receptacles can be arranged in different patterns and configurations.

Figure 5:
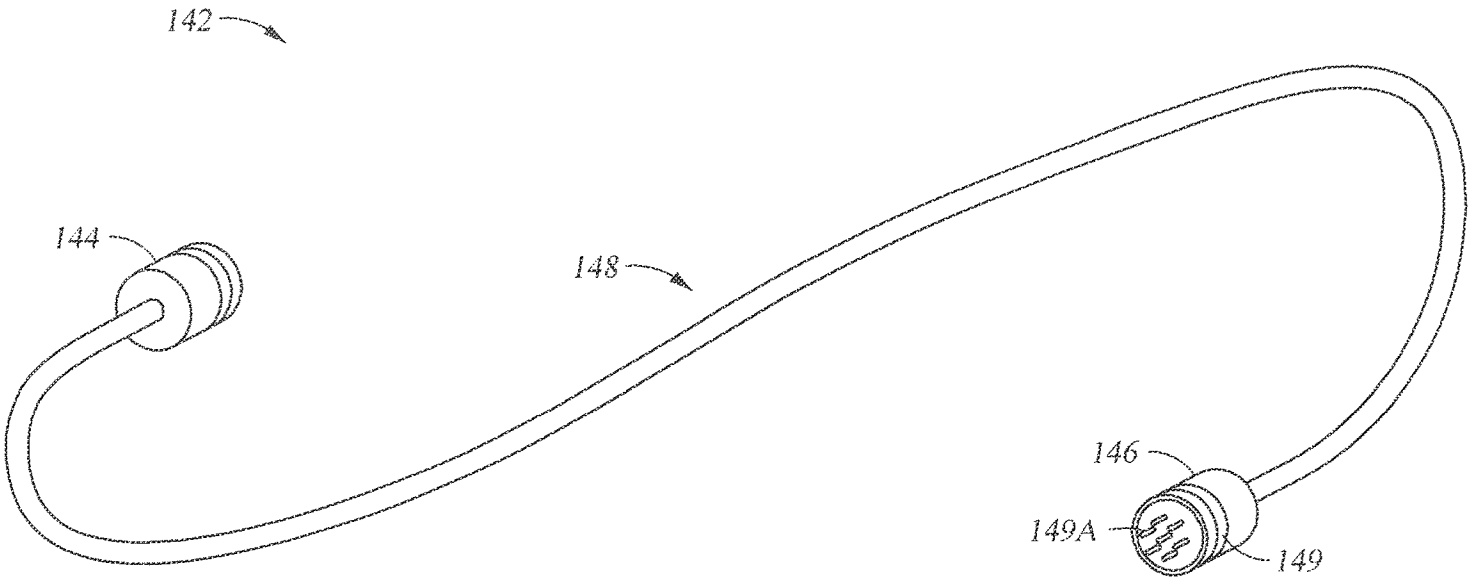
FIG. 5 is a side perspective view of an example of a cable assembly for use in electrical communication between the transformer and fracturing pump system of FIG. 2.

FIG. 5 shows in a side perspective view one example of a cable assembly 142 which includes plugs 144, 146 and a cable 148 extending between the plugs 144, 146 which provides electrical communication between plugs 144, 146. Plugs 144, 146 as shown each have an outer periphery configured so that plugs 144, 146 can be readily inserted into and removed from openings $\mathbf{114}_1$-$\mathbf{114}_6$, $\mathbf{120}_1$-$\mathbf{120}_6$, $\mathbf{130}_1$-$\mathbf{130}_6$, $\mathbf{136}_1$-$\mathbf{136}_6$. Optionally included with the plugs 144, 146 are electrodes 149 which are electrically conductive elements. Electrodes 149 are shown formed along the outer curved surface of plugs 144, 146 and can be recessed or inlayed on the surface of the plugs 144, 146 or can project radially outward. Alternate examples of electrodes 149A resemble planar prongs that project axially outward from the respective ends of plugs 144, 146 opposite from their connection to cable 148. When the plugs 144, 146 are inserted into a one of the receptacles $\mathbf{112}_1$-$\mathbf{112}_6$, $\mathbf{118}_1$-$\mathbf{118}_6$, $\mathbf{128}_1$-$\mathbf{128}_6$, $\mathbf{134}_1$-$\mathbf{134}_6$ of FIG. 3 or 4, the electrodes 149, 149A come into electrically conducting contact with corresponding electrodes (not shown) provided within the receptacles $\mathbf{112}_1$-$\mathbf{112}_6$, $\mathbf{118}_1$-$\mathbf{118}_6$, $\mathbf{128}_1$-$\mathbf{128}_6$, $\mathbf{134}_1$-$\mathbf{134}_6$; and thereby providing electrical communication one of the receptacles $\mathbf{112}_1$-$\mathbf{112}_6$, $\mathbf{118}_1$-$\mathbf{118}_6$ disposed injunction box 98 and one of the receptacles $\mathbf{128}_1$-$\mathbf{128}_6$, $\mathbf{134}_1$-$\mathbf{134}_6$ disposed injunction box 100.

Referring back to FIG. 2, line 150 is shown within fracturing pump system 36A and extending from a side of junction box 100 opposite from cable bundle 102 and connecting to motor 86. Accordingly, electrical communication between transformer 56 and motor 86 takes place from junction box 98, through cable bundle 102, to junction box 100, then to line 150. Although shown as a single line, line 150 can be made up of a plurality of electrically conducting elements such as lines or cables and may include a variable frequency drive. One specific example of forming cable bundle 102, six of the cable assemblies 142 are provided, and one of plugs 144, 146 are inserted into each of the openings 1141-1146 of receptacles 1121-1126. The other one of the plugs 144, 146 of cable assemblies 142 is then inserted into a corresponding opening 1301-1306 of receptacles 1281-1286. Thus in one example the six cable assemblies 142 extending between the receptacles 1121-1126 to receptacles 1281-1286 define cable bundle 102 for powering motor 86. An advantage of the cable assemblies 142 with insertable and removable plugs 144, 146 and receptacles 1121-1126 and receptacles 1281-1286 is that the electrical communication between transformer 56A and motor 86 can be assembled in a matter of minutes, versus the hours that has typically been required for hardwiring the electrical connection between the transformer 56A and motor 86. Similarly, cable bundle 104 is formed by providing six of the cable assemblies 142 and connecting them with the plugs 144, 146 into the receptacles 1181-1186 and receptacles 1341-1346. In similar fashion, a ground connection 108 between transformer 56A and fracturing pump system 36A is created by providing cable assembly 142 and inserting one of plugs 144, 146 into ground connection 122 and the other one of the plugs 144, 146 into ground connection 138. Optionally, simple bolt on lug attachments (not shown) can be used in lieu of the cable assemblies 142 for the ground connections 122, 138. Thus, while cable bundles 102, 104 each include six or more of the cable assemblies 142, example lines 106, 108 can include a single cable assembly 142. Alternatively, line 106 is made up of four internal conductors and have threaded end connections instead of the plugs. Optionally, cable bundles 102, 104 can be made up of less than six cable assemblies 142, or more than six cable assemblies 142.

In the example of FIG. 2 power to motors 84, 86 from transformer 56A is provided along separate and distinctive paths. A separate VFD may control and operate motor 84 while a second VFD controls and operates motor 86. An advantage of the separate and distinct paths of providing power to motors 84, 86 is that should power to one of motors 84, 86 be interrupted, power to the other one of the motors 84, 86 is not affected. More specifically, adjacent rows 110, 116 are not in communication with one another, adjacent rows 126, 132 are not in communication with one another; and adjacent cable bundles 102, 104 are not in communication with one another. Finally, lines 150, 152 are also separate and insulated from each other so that independent electrical paths are maintained for both the motors 84, 86. An additional advantage is provided by the dedicated ground line which plugs into ground connections 122, 138. The dedicated ground line may reduce voltage differential between equipment. In another embodiment, one VFD controls and operates one motor (either 84 or 86), which then controls both pump 80 and pump 82.

Figure 6:
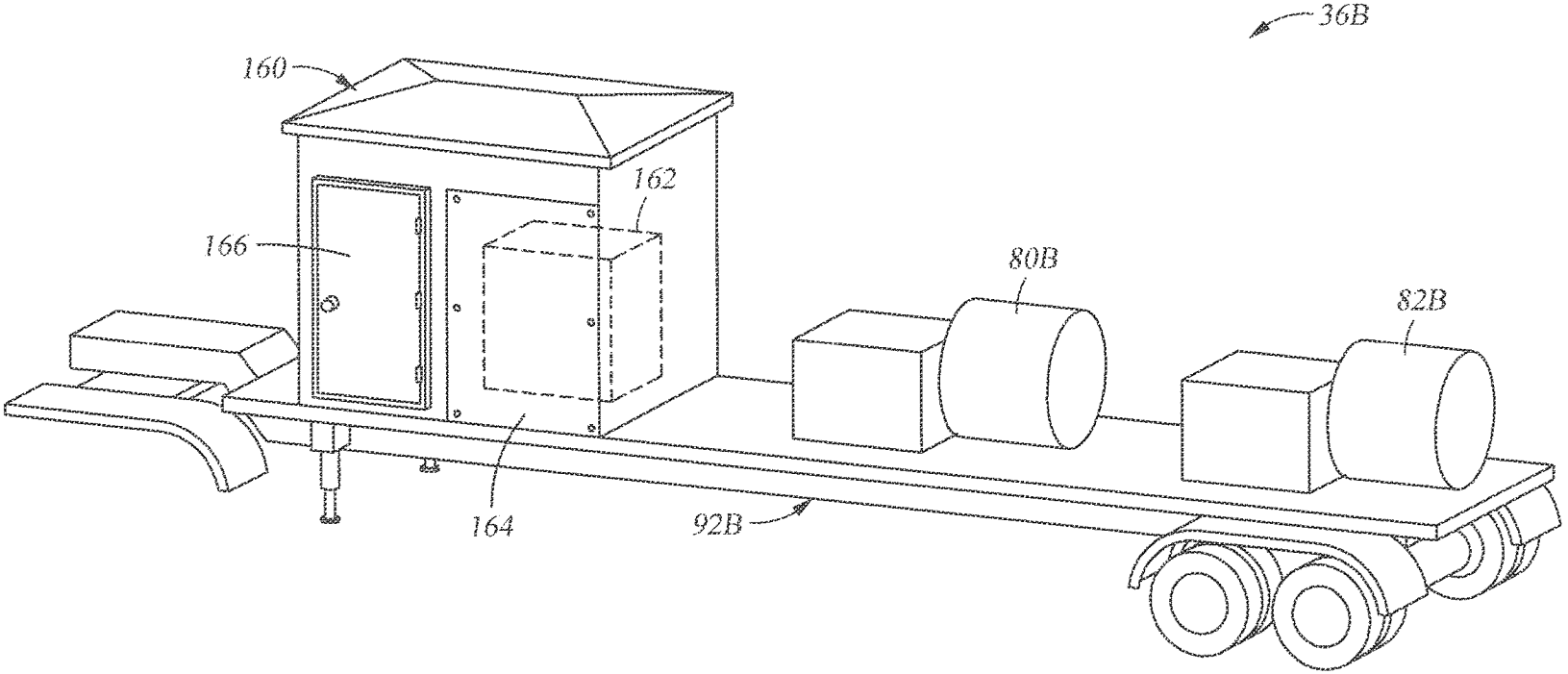
FIG. 6 is a side perspective view of an example of the fracturing pump system of FIG. 2.

FIG. 6 shows in a side perspective view one example of a fracturing pump system 36B mounted on trailer 92B. In this example, an end of trailer 92B distal from pumps 80B, 82B includes an enclosure 160 and inside of which is an example of a variable frequency drive 162 shown in a dashed outline. Adjacent variable frequency drive 162 a panel 164 is formed on enclosure 160, where panel 164 is readily removable from enclosure to give ready and full access to variable frequency drive 162. Panel 164 thus provides a way of quick and easy access for the repair, replacement, and/or maintenance of variable frequency drive 162. Also provided on enclosure 160 is a door 166 which allows access by operations personnel to inside of enclosure 160 to access and monitor various controls provided within enclosure 160. In one embodiment, the enclosure 160 includes two air conditioning units. Having two air conditioning units provides redundant cooling systems. Each air conditioning unit is capable of cooling both VFDs in the enclosure by itself should the other fail or need to be shut down for repair and maintenance.

Figure 7:
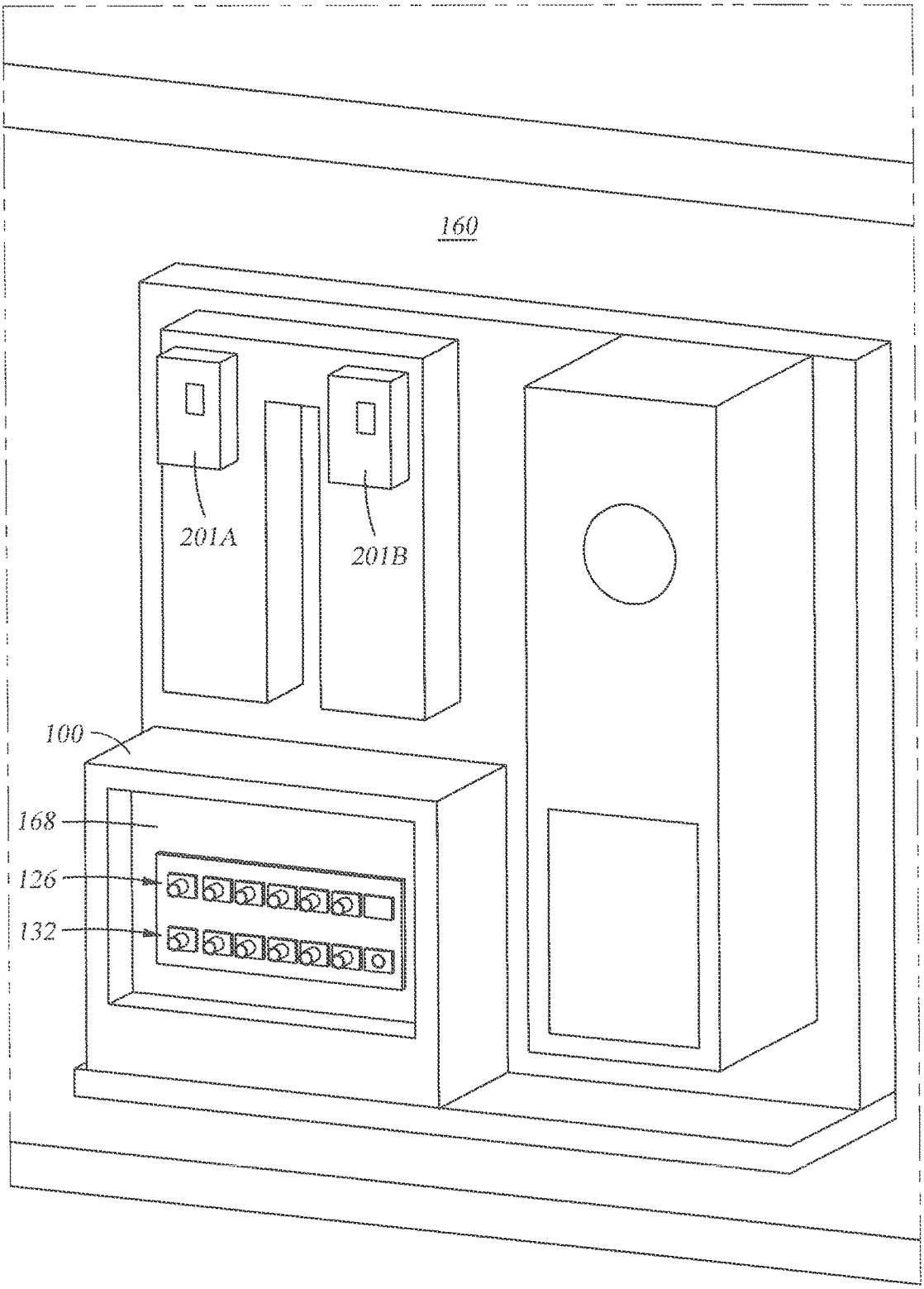
FIG. 7 is an end perspective view of the fracturing pump system of FIG. 6.

FIG. 7 shows an end perspective view of one example of enclosure 160, and wherein rows 126, 132 are provided in a recess 168 formed within junction box 100. Included in this example is an optional electric filter 201A in communication with the first VFD and motor 84 and a second electric filter 201B in communication with the second VFD and motor 86. Optionally, a second variable frequency drive (not shown) is provided within enclosure 160 and on a side opposite panel 164; a second panel (not shown) can be formed on enclosure to facilitate access to second variable frequency drive. In this example, each motor 80B, 82B is coupled with a dedicated variable frequency drive. In one embodiment, there is a second door for the enclosure providing a second, separate and distinct escape path from the enclosure. In one embodiment, the exit doors open outwards to allow for quick egress from the enclosure 160.

Referring back to FIGS. 3 and 4, the arrangement of the receptacles $\mathbf{112}_1$-$\mathbf{112}_6$, $\mathbf{118}_1$-$\mathbf{118}_6$, $\mathbf{128}_1$-$\mathbf{128}_6$, $\mathbf{134}_1$-$\mathbf{134}_6$ on junction boxes 98, 100 are generally mirror images of one another. Thus, when inserting one of plugs 144, 146 into receptacle $\mathbf{112}_1$, the corresponding receptacle, which is $\mathbf{128}_1$, will be aligned so that the cable assembly 142 can run along a generally straight path between junction boxes 98, 100 and without interfering with other cable assemblies 142 that connect into other receptacles. Moreover, in the illustrated example motors 84, 86 operate on three phase electricity, thus, in an alternative, the adjacent ones of receptacles transmit electricity that is at the same phase. For example, receptacles $\mathbf{112}_1$-$\mathbf{112}_2$ may transmit electricity at one phase, whereas receptacles $\mathbf{112}_3$, $\mathbf{112}_4$ transmit electricity at a different phase, and receptacles $\mathbf{112}_5$, $\mathbf{112}_6$ transmit electricity at yet another phase, wherein these different phases are approximately 120° apart. Further in this example, receptacles $\mathbf{128}_1$, $\mathbf{128}_2$ operate at one phase, wherein receptacles $\mathbf{128}_3$, $\mathbf{128}_4$ operate at another phase, and receptacles $\mathbf{128}_5$, $\mathbf{128}_6$ operate at a third phase. In one specific example, receptacles $\mathbf{112}_1$, $\mathbf{112}_2$ operate at the same phase as receptacles $\mathbf{128}_1$, $\mathbf{128}_2$, receptacles $\mathbf{112}_3$, $\mathbf{112}_4$ operated at the same phase as receptacles $\mathbf{128}_3$, $\mathbf{128}_4$, and receptacles $\mathbf{112}_5$, $\mathbf{112}_6$ operate at the same phase as receptacles $\mathbf{128}_5$, $\mathbf{128}_6$. By strategically forming a cable bundle 102, 104 made up of wires having dedicated phases, and allocating the same phase of electricity to cross more than one wire, a gauge of wire for the cable assemblies 142 can be formed which is manageable by operations personnel, which is another advantage of the present disclosure and which speeds the assembly and disassembly of the fracturing system 10.

Figure 8:
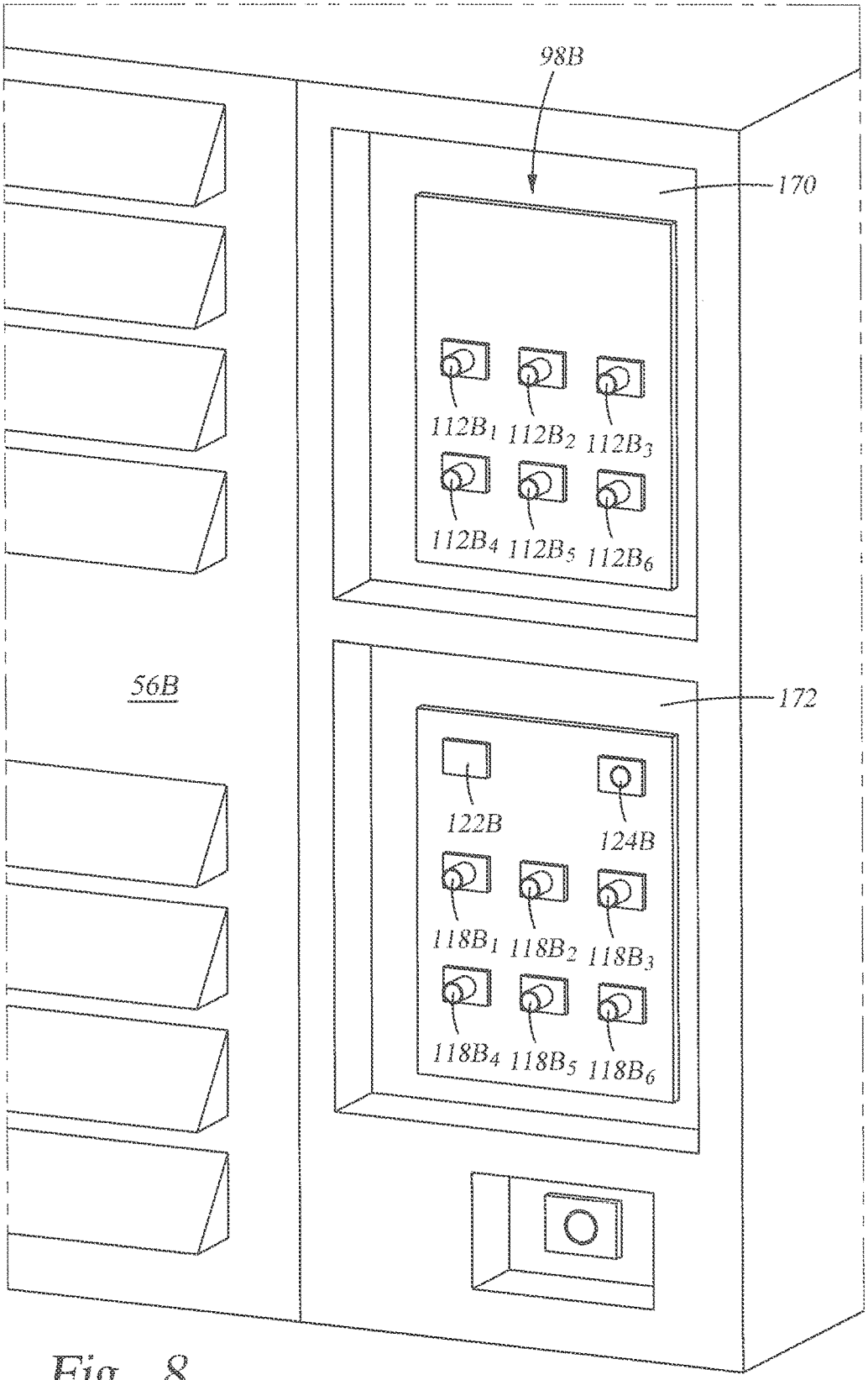
FIG. 8 is an end perspective view of an example of the transformer of FIG. 2.

FIG. 8 shows an end perspective view of an example of transformer 56B having recesses 170, 172 and with its sets of receptacles $\mathbf{112}B_1$-$\mathbf{112}B_6$ and $\mathbf{118}B_1$-$\mathbf{118}B_6$ each arranged in a pair of rows respectively in the recesses 170, 172. As shown, receptacles $\mathbf{112}B_1$-$\mathbf{112}B_6$ are arranged so that receptacles $\mathbf{112}B_1$ and $\mathbf{112}B_4$ are vertically aligned with one another, receptacles $\mathbf{112}B_2$ and $\mathbf{112}B_5$ are vertically aligned with one another, and receptacles $\mathbf{112}B_1$ and $\mathbf{112}B_6$ are vertically aligned with one another. In this example, receptacles $\mathbf{112}B_1$ and $\mathbf{112}B_4$ are in communication with electricity at a first phase, receptacles $\mathbf{112}B_2$ and $\mathbf{112}B_5$ are in communication with electricity at a second phase, and receptacles $\mathbf{112}B_3$ and $\mathbf{112}B_6$ are in communication with electricity at a third phase; where the first, second, and third phases are different, and can be about 120° apart from one another. Further illustrated are that receptacles $\mathbf{118}B_1$-$\mathbf{118}B_6$ in recess 172 are arranged so that receptacles $\mathbf{118}B_1$ and $\mathbf{118}B_4$ are vertically aligned with one another, receptacles $\mathbf{118}B_2$ and $\mathbf{118}B_5$ are vertically aligned with one another, and receptacles $\mathbf{118}B_3$ and $\mathbf{118}B_6$ are vertically aligned with one another. In this example, receptacles $\mathbf{118}B_1$ and $\mathbf{118}B_4$ are in communication with electricity at a first phase, receptacles $\mathbf{118}B_2$ and $\mathbf{118}B_5$ are in communication with electricity at a second phase, and receptacles $\mathbf{118}B_3$ and $\mathbf{118}B_6$ are in communication with electricity at a third phase; where the first, second, and third phases are different, and can be about 120° apart from one another. Additionally, ground connection 122B and auxiliary connection 124B are shown disposed in recess 172.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, other the recesses can be put into arrangements other than those described, such as all being in a vertical or other arrangement. These and other similar modifications will readily suggest themselves to those skilled in the art, and are intended to be encompassed within the spirit of the present invention disclosed herein and the scope of the appended claims.

What is claimed is:

1. A hydraulic fracturing system, comprising:

a trailer;

a hydraulic fracturing pump supported by the trailer and being configured to pump hydraulic fracturing fluid;

an electric motor that drives the hydraulic fracturing pump, the electric motor supported by the trailer;

an enclosure supported by the trailer;

a variable frequency drive (VFD) housed in the enclosure, the VFD being operably connected to the electric motor to control a speed of the electric motor; and a three-phase transformer configured to distribute power to the electric motor, the three-phase transformer comprising:

a first pair of receptacles that transmit electricity in a first phase to the electric motor;

a second pair of receptacles that transmit electricity in a second, distinct, phase to the electric motor; and a third pair of receptacles that transmit electricity in a third, distinct, phase to the electric motor.

2. The hydraulic fracturing system of claim 1, wherein:

the first pair of receptacles are vertically aligned with each other;

the second pair of receptacles are vertically aligned with each other; and the third pair of receptacles are vertically aligned with each other.

3. The hydraulic fracturing system of claim 2, wherein each receptacle of the first, second and third pairs of receptacles is a quick disconnect receptacle.

4. The hydraulic fracturing system of claim 1, wherein the electric motor comprises:

a fourth pair of receptacles that receives electricity in the first phase from the three-phase transformer;

a fifth pair of receptacles that receives electricity in the second, distinct, phase from the three-phase transformer; and a sixth pair of receptacles that receives electricity in the third, distinct, phase from the three-phase transformer.

5. The hydraulic fracturing system of claim 4, comprising:

a first cable bundle that couples the first pair of receptacles to the fourth pair of receptacles;

a second cable bundle that couples the second pair of receptacles to the fifth pair of receptacles; and a third cable bundle that couples the third pair of receptacles to the sixth pair of receptacles.

6. The hydraulic fracturing system of claim 4, wherein an arrangement of the first, second and third pairs of receptacles on the three-phase transformer mirrors an arrangement of the fourth, fifth and sixth pairs of receptacles on the electric motor.

7. The hydraulic fracturing system of claim 1, comprising:

a second hydraulic fracturing pump supported by the trailer and being configured to pump hydraulic fracturing fluid;

a second electric motor that drives the second hydraulic fracturing pump, the second electric motor supported by the trailer; and a second variable frequency drive (VFD) housed in the enclosure, the second VFD being operably connected to the second electric motor to control a speed of the second electric motor.

8. The hydraulic fracturing system of claim 7, wherein the three-phase transformer comprises:

a seventh pair of receptacles that transmit electricity at a first phase to the second electric motor;

a eighth pair of receptacles that transmit electricity at a second, distinct, phase to the second electric motor; and a ninth pair of receptacles that transmit electricity at a third, distinct, phase to the second electric motor.

9. The hydraulic fracturing system of claim 8, wherein the second electric motor comprises:

a tenth pair of receptacles that receives electricity at a first phase from the three-phase transformer;

a eleventh pair of receptacles that receives electricity at a second, distinct, phase from the three-phase transformer; and a twelfth pair of receptacles that receives electricity at a third, distinct, phase from the three-phase transformer.

10. The hydraulic fracturing system of claim 9, comprising:

a fourth cable bundle that couples the seventh pair of receptacles to the tenth pair of receptacles;

a fifth cable bundle that couples the eighth pair of receptacles to the eleventh pair of receptacles; and a sixth cable bundle that couples the ninth pair of receptacles to the twelfth pair of receptacles.

11. A hydraulic fracturing method, comprising:

pumping hydraulic fracturing fluid by operation of a hydraulic fracturing pump, wherein the hydraulic fracturing pump is supported by a trailer;

driving the hydraulic fracturing pump by operation of an electric motor supported by the trailer;

controlling a speed of the electric motor by operation of a variable frequency drive (VFD) housed in an enclosure supported by the trailer; and providing electric power to the electric motor from a three-phase transformer, wherein the three-phase transformer steps down a voltage of the electric power received from a power source, the three-phase transformer comprising:

a first pair of receptacles that transmit electricity in a first phase to the electric motor;

a second pair of receptacles that transmit electricity in a second, distinct, phase to the electric motor; and a third pair of receptacles that transmit electricity in a third, distinct, phase to the electric motor.

12. The method of claim 11, wherein:

vertically aligning the first pair of receptacles with each other;

vertically aligning the second pair of receptacles with each other; and vertically aligning the third pair of receptacles with each other.

13. The method of claim 12, wherein each receptacle of the first, second and third pairs of receptacles is a quick disconnect receptacle.

14. The method of claim 11, wherein the electric motor comprises:

a fourth pair of receptacles that receives electricity in the first phase from the three-phase transformer;

a fifth pair of receptacles that receives electricity in the second, distinct, phase from the three-phase transformer; and a sixth pair of receptacles that receives electricity in the third, distinct, phase from the three-phase transformer.

15. The method of claim 14, comprising:

coupling the first pair of receptacles to the fourth pair of receptacles with a first cable bundle;

coupling the second pair of receptacles to the fifth pair of receptacles with a second cable bundle; and coupling the third pair of receptacles to the sixth pair of receptacles with a third cable bundle.

16. The method of claim 14, wherein an arrangement of the first, second and third pairs of receptacles on the three-phase transformer mirrors an arrangement of the fourth, fifth and sixth pairs of receptacles on the electric motor.

17. The method of claim 11, comprising:

pumping hydraulic fracturing fluid by operation of a second hydraulic fracturing pump, wherein the second hydraulic fracturing pump is supported by the trailer;

driving the second hydraulic fracturing pump by operation of a second electric motor supported by the trailer; and controlling a speed of the second electric motor by operation of a second variable frequency drive (VFD) housed in an enclosure supported by the trailer.

18. The method of claim 17, wherein the three-phase transformer comprises:

a seventh pair of receptacles that transmit electricity at a first phase to the second electric motor;

a eighth pair of receptacles that transmit electricity at a second, distinct, phase to the second electric motor; and a ninth pair of receptacles that transmit electricity at a third, distinct, phase to the second electric motor.

19. The method of claim 18, wherein the second electric motor comprises:

a tenth pair of receptacles that receives electricity at a first phase from the three-phase transformer;

a eleventh pair of receptacles that receives electricity at a second, distinct, phase from the three-phase transformer; and a twelfth pair of receptacles that receives electricity at a third, distinct, phase from the three-phase transformer.

20. The method of claim 19, comprising:

coupling the seventh pair of receptacles to the tenth pair of receptacles with a fourth cable bundle;

coupling the eighth pair of receptacles to the eleventh pair of receptacles with a fifth cable bundle; and coupling the ninth pair of receptacles to the twelfth pair of receptacles with a sixth cable bundle.

* * * * *